US005745093A

United States Patent [19]

Tsuzuki et al.

[11] Patent Number: 5,745,093

[45] Date of Patent: Apr. 28, 1998

[54] LIQUID CRYSTAL DISPLAY DRIVING SYSTEM

[75] Inventors: Yoshiji Tsuzuki; Tsutomu Sakamoto, both of Saitama-ken, Japan

[73] Assignee: Kabushiki Kaisha Toshiba, Kawasaki, Japan

[21] Appl. No.: 67,831

[22] Filed: May 27, 1993

[30] Foreign Application Priority Data

May 27, 1992 [JP] Japan ..... 4-135143

[51] Int. Cl.[6] ..... G09G 3/36

[52] U.S. Cl. ..... 345/103; 345/88; 345/94; 345/208; 349/78

[58] Field of Search ..... 345/87, 88, 103, 345/100, 208, 93, 94, 95, 67, 210; 359/55; 349/143, 106, 78, 97, 79, 80

[56] References Cited

U.S. PATENT DOCUMENTS

| | | | |
|---|---|---|---|
| 4,740,786 | 4/1988 | Smith | 345/103 |
| 4,822,142 | 4/1989 | Yasui | 345/103 |
| 4,830,460 | 5/1989 | Matsuhashi et al. | 345/103 |
| 4,859,998 | 8/1989 | Kawamura et al. | 345/94 |
| 5,103,218 | 4/1992 | Takeda | 345/100 |
| 5,192,945 | 3/1993 | Kusada | 345/88 |
| 5,512,915 | 4/1996 | Leronx | 345/103 |

FOREIGN PATENT DOCUMENTS

| | | | |
|---|---|---|---|
| 0441692 | 8/1991 | European Pat. Off. . | |
| 0461928 | 12/1991 | European Pat. Off. . | |
| 2700050 | 7/1994 | France | 345/103 |

OTHER PUBLICATIONS

Patent Abstracts of JP 2084685, Mar. 1990.
Patent Abstracts of JP 21 70784, Jul. 1990.

*Primary Examiner*—Richard Hjerpe
*Assistant Examiner*—Lun-Yi Lao
*Attorney, Agent, or Firm*—Cushman, Darby & Cushman IP Group of Pillsbury Madison & Sutro LLP

[57] ABSTRACT

A liquid crystal display system includes a liquid crystal display having liquid crystal pixel elements arranged in a matrix; data lines for driving pixel columns and scanning signal lines for driving pixel rows. The system has a circuit for supplying video signal to pixels through data lines and a scanning signal line controller for supplying a progressive scanning signal to the scanning signal lines. The data lines are driven by four sample-hold circuits. The first sample-hold circuit samples and holds video signals for pixels corresponding to odd rows on a first side of the screen and supplies them to data lines corresponding to the first side on the screen based on a first output directing signal. A second sample-hold circuit samples and holds video signals for pixels corresponding to even rows on the first side of the screen and supplies them to data lines corresponding to the first side on the screen based on a second output directing signal. A third sample-hold circuit samples and holds video signals for pixels corresponding to odd rows on a second side of the screen and supplies them to data lines corresponding to the second side on the screen based on a third output directing signal. A fourth sample-hold circuit samples and holds video signals for pixels corresponding to even rows on the second side of the screen and supplies them to data lines corresponding to the second side on the screen based on a fourth output directing signal.

61 Claims, 12 Drawing Sheets

(a) VIDEO SIGNAL
(b) STH
(c) OE 1
(d) OE 2
(e) OE 3
(f) OE 4
(g) Y11
(h) Y12
(i) Y21
(j) Y22
(k) SHp1
(l) SHp2
(m) SHq1
(n) SHq2

LIQUID CRYSTAL DISPLAY DRIVING SYSTEM

FIELD OF THE INVENTION

The present invention relates generally to a liquid crystal display driving system.

BACKGROUND OF THE INVENTION

Because of advantages of small size, light weight and low power consumption, liquid crystal display panels have been adopted on various kinds of displays in recent years. For television video display, high resolution liquid crystal display panels with more than 400 pixels in the vertical direction have been used recently. The liquid crystal has a capacitance and a holding time of their written signals is relatively long. Because of this, if an interlace scanning system is adopted, the first and the second fields may be displayed simultaneously, causing a picture to show a shift. Further, if the interlace scanning system is used, it becomes necessary to drive a liquid crystal for each frame with AC power and is conspicuous flickering can result.

Therefore, a liquid crystal display driving system employing a double-speed scanning system using a line memory might be adopted so far to display one picture in one field (the full-line driving). FIG. 1 is an explanatory diagram showing a conventional liquid crystal display driving system employing such a double-speed line sequential scanning system with the pixels arranged in a delta shape. FIG. 2 is an explanatory diagram schematically showing Section A encircled in FIG. 1. Further, FIG. 3 is a timing chart for explaining the operation of this liquid crystal display driving system. FIG. 3(*a*) shows a video signal, FIG. 3(*b*) shows a start signal (hereinafter referred to as an STH pulse), FIG. 3(*c*) shows a control signal, FIGS. 3(*d*) through 3(*g*) show 1st, 3rd, 2nd and 4th output enable signals (hereinafter referred to as the OE1, OE3, OE2 and OE4 signals), respectively, FIGS. 3(*h*) through 3(*k*) show the state of the gate lines Y11, Y12, Y21 and Y22, respectively, and FIGS. 3(*l*) through 3(*o*) show the operating state of the sample-hold circuits SHm1, SHm3, SHm2 and SHm4 (m=1, 2. . . , n) respectively. Further, S/H in FIG. 3 shows the sample-hold operation and W shows the write operation to the data lines.

In FIG. 1, a liquid crystal cell 1 is constructed by providing a twist nematic liquid crystal material (not shown) between a pair of plate glass sheets (not shown). A common electrode is formed on one of the plate glass sheets, and gate lines Y (Y11, Y12, Y21, Y22, . . . ) and n data lines X (X1 through Xn) are formed on the other plate glass sheet, and pixel electrodes (not shown) are formed on the intersections of the gate lines Y and the data lines X. Pixels are arranged in the matrix shape at the intersections of the gate lines Y and the data lines X with a thin film transistor (TFT) 2 shown in FIG. 2 provided to each of the pixels. A gate signal is supplied to a gate G of each TFT 2 from a gate line controller 3 (hereinafter referred to as the Y driver) through the gate line Y and a video signal sampling voltage from a data line driving circuit (hereinafter referred to as the X driver) 4 is supplied to a source S through the data line X, and a drain D is connected to the pixel electrode. A liquid crystal capacitance is generated by a liquid crystal 5 which is formed between the pixel electrode and the common electrode. Further, an auxiliary capacitor Cs is provided in parallel with the liquid crystal capacitance. The TFT 2 is turned ON by a high level (hereinafter referred to as "H") gate signal from the gate line Y to apply the video signal sampling voltage from the data line X to the pixel electrode.

As a result, a liquid crystal display comprising the pixels is driven to display a picture.

The liquid crystal cell 1 has adopted the delta arrangement of liquid crystal pixels of odd lines and even lines with half of the pixels shifted in the horizontal scanning direction, as shown in FIG. 1, and the number of lines has been set so that they are sufficient enough to display one frame of a video broadcast signal. As described above, video signals are supplied simultaneously to two lines of the liquid crystal cell 1 in one horizontal (1H) period and, as shown in FIGS. 3(*h*) through 3(*k*), the Y driver 3 makes two gate lines Y11 and Y12, and Y21 and Y22, . . . to "H" sequentially in one horizontal period. Thus, video signals are written for all pixels in one field period.

In order to write video signals for pixels of the odd lines and pixels of the even lines through independent data lines X, it is necessary to make the number of data lines twice as large as the number of pixels in the horizontal direction and as a result, the number of data lines will increase, making it difficult to manufacture liquid crystals. For this reason, video signals are supplied to the pixels for the odd lines and the even lines which are shifted by half pixels through the same data lines X, as shown in FIG. 1. Further, R, G and B in FIG. 1 show the arrangement of R (red), G (green) and B (blue) color filters.

The X driver 4 is composed of a shift register 6, a switch group 7, a sample-hold circuit group 8 and a buffer amplifier group 9. When supplied with the start pulse STH (FIG. 3(*b*)) showing the start of the horizontal display period, the shift register 6 outputs an ON pulse as the pulses are turned ON sequentially from the first bit at a timing in synchronism with clock CLK. Further, the clock CLK is set a frequency based on twice the number of pixels in the horizontal direction of the liquid crystal 1. The switches S11, S12 through Sn1, Sn2 of the switch group 7 output ON pulse to the sample-hold circuit group 8 under the control of the control signal (FIG. 3(*c*)).

The sample-hold circuit group 8 is composed of 4n sample-hold circuits SH (SH11 through SH14, SH21 through SH24, . . . SHn1 through SNn4), and each sample-hold circuit SH samples three primary color video signals R, G and B, which are input through the terminals 11 through 13, at the ON pulse timing from the switch group 7 and holds them. The sample-hold circuits SH supply the video signals they are holding to buffer amplifiers B (B11 through B14, B21 through B24, . . . , Bn1 through Bn4) of the buffer amplifier group 9. When turned ON by the OE1, OE2, OE3 and OE4 signals, the buffer amplifier B supplies video signals from the sample-hold circuit SH to the data lines X1 through Xn and executes the write to the pixels of the liquid crystal 1.

If one sample-hold circuit is used for one pixel of the liquid crystal 1, it becomes necessary to perform the write to the pixels within the horizontal blanking period (BLK) because it is necessary to stagger the sample-hold period and the write to pixels operations relative to each other. That is, it is necessary to write video signals from two sample-hold circuits to two pixels of the odd lines and even lines through one data line within one horizontal blanking period. Accordingly, the write to one pixel must be performed in half the time (about 5 μsec.) of one horizontal blanking period. In such a short time, the write cannot be carried out sufficiently because of the time constant of liquid crystal, and the contrast will become indistinct. For this reason, in FIG. 1, two sample-hold circuits are provided for one pixel, enabling it to switch the read and write, thus providing a sufficient write time for the liquid crystal display.

The sample-hold circuits SH11 and SH12 correspond to the pixels on the first column of the odd lines of the liquid crystal 1, while the sample-hold circuits SH13 and SH14 correspond to the pixels on the first column of the even lines of the liquid crystal 1. Similarly, the sample-hold circuits SHm1, SHm2 (m=1, 2, . . . , n) correspond to the m row of the odd lines and the sample-hold circuits SHm3 and SHm4 correspond to the m th row of the even lines of the liquid crystal 1. If the sample-hold circuits SHm1 and SHm3 hold video signals within the prescribed horizontal scanning period by the ON pulse from the switches Sm1 and Sm2 as shown in FIGS. 3(*l*) through 3(*o*), the sample-hold circuit SHm2 performs the write to the pixels of the odd lines in the first half of one horizontal scanning period and the sample-hold circuit SHm4 performs the write to the pixels of the even lines in the latter half of the horizontal scanning period according to the OE2 and the OE4 signals shown in FIGS. 3(*f*) and 3(*g*), respectively. On the contrary, if the sample-hold circuits SHm1 and SHm4 hold video signals in a prescribed horizontal period, the sample-hold circuit SHm1 performs the write to the pixels of the odd lines in the first half of one horizontal period and the sample-hold circuit SHm3 performs the write to the pixels of the even lines in the latter half of one horizontal period.

As a result, the circuits shown in FIG. 1 are provided with sufficient times for write operations. However, as two sample-hold circuits are used for one pixel, the size of the liquid crystal display will become large. In particular, the sample-hold circuits have capacities significant sizes and if they are integrated, an extremely large space is required and a large overall size and high cost will result.

So, the applicant of the present application has proposed a method to solve these problems in the Japanese Patent Application (TOKU-GAN-HEI) 2-84685. FIG. 4 is an explanatory diagram for explaining the method.

FIG. 4 shows the construction of the X driver which, differing from the conventional liquid crystal display driving system shown in FIG. 1, is provided with the sample-hold circuits and the buffer amplifiers corresponding to the pixels of the liquid crystal cell 1 on a one-for-one basis. That is, an X driver 19 is composed of the shift register 6, the sample-hold circuit group 15 and the buffer amplifier group 16. The outputs of all bits of the shift resister 6 are applied to the sample-hold circuits SH (SH11, SH12, SH21, SH22, . . . SHn1, SHn2) of the sample-hold circuit group 16. The sample-hold circuits SH sample the primary color signals R, G and B which are input through the terminals 11 through 13 at the ON pulse timing from the shift register 6 and hold them. The outputs of the sample-hold circuits SH11 and SH12 are applied to the data line X1 through the buffer amplifiers B11 and B12, respectively. Similarly, the outputs of the sample-hold circuits SHm1 and SHm2 (m=1, 2, . . . , n) are applied to the data lines Xm through the buffer amplifiers Bm1, and Bm2. The buffer amplifiers B11, B12, . . . , Bn1, Bn2 are turned ON by the OE1 through the OE4 signals and apply the output of the sample-hold circuits SH to the data lines X.

The operation of a conventional embodiment shown in FIG. 4 will now be explained with reference to the timing chart, as shown in FIG. 5.

When the start signal STH (FIG. 5(*b*)) generated at the start timing of the horizontal scanning period is input, the shift register 6 shifts the ON pulse by one bit at a time in the clock CLK period and applies them to the sample-hold circuits SH. As a result, the sample-hold circuits SHp1 and SHp2 (p=1, 2, . . . n/2) sample and hold video signals in the first half of the horizontal scanning period, as shown in FIGS. 5(*k*) and 5(*l*), and the sample-hold circuits SHq1 and SHq2 (q=n/2+1, . . . n) sample and hold video signals in the latter half of the horizontal scanning period, as shown in FIGS. 5(*m*) and 5(*n*).

On the other hand, as shown in FIG. 5(*c*), the OE1 signal becomes "H" for ¼ of a horizontal period from the latter half of the horizontal scanning period and the sample-hold circuit SHp1 applies the holding video signals to the data line Xp through the buffer amplifier Bp1 during this period. On the other hand, the Y driver 3 applies an "H" gate signal to the gate line Y11 during this period (FIG. 5(*g*)) and as a result, the video signals are written for the pixels corresponding to the left side of the first line on the screen of the liquid crystal 1 (FIG. 5(K)).

After the period of H/4 has elapsed from the latter half of the horizontal scanning period, the OE2 signal becomes "H" for the period of H/4 instead of the OE1 signal (FIG. 5(*d*)). As a result, the video signals held by the sample-hold circuit SHp2 are supplied to the data line Xp through the buffer amplifier Bp2. During this period, the gate line Y12 is kept at "H" (FIG. 5(*h*)) by the gate signal from the Y driver 3, and the video signals are written for the pixels corresponding to the left side of the second line on the screen of the liquid crystal 1 (FIG. 5(*l*)).

Further, as shown in FIG. 5(*e*), when the OE2 signal changes from "H" to "L", the OE3 signal becomes "H" only for ¼ of the horizontal period. During the period when the OE3 signal is "H", the gate line Y12 also becomes "H" and the video signals from the sample-hold circuit SHq1 are written for the pixels corresponding to the right side of the first line on the screen of the liquid crystal 1 through the buffer amplifier Hq1 and the data line Zq (FIG. 5(*m*)). Further, when the OE3 signal returns to "L", the OE4 signal becomes "H" for the period of H/4 (FIG. 5(*f*)) for the OE3 signal. Then, the sample-hold circuit SHq2 applies the video signals to the data line Xq through the buffer amplifier Bq2 and the video signals are written for the pixels corresponding to the right side of the second line on a screen of the liquid crystal 1 (FIG. 5(*n*)). Thereafter, the similar operation is carried out repeatedly.

Thus, the video signals corresponding to the pixels at the left side of the screen, which are sampled and held by the sample-hold circuits SHp1 and SHp2, are written in the H/4 period from the latter half of the horizontal scanning period, respectively after the end of the sample-hold period and the video signals corresponding to the right side of the screen, which are sampled and held by the sample-hold circuits SHq1 and SHq2, are written in the H/4 period, respectively after the end of the sample-hold period. The sample and hold of video signals are carried out by the sample-hold circuits corresponding to the pixels on a one-for-one basis in a sufficient time for writing to the pixels.

However, the data line X has a relatively large floating capacitance. Actually, therefore, the video signals from the buffer amplifier B are first held by the data line X and then are written for the pixels. That is, even when the buffer amplifier is turned OFF, the video signals are written for the pixels by the floating capacitance of the data line. Now, it is assumed that, for instance, the OE1 signal is held at "H" and the gate line 21 is also held at "H". In this case, the video signals from the sample-hold circuit SHp1 are written for the pixels at the left side of the screen as described above. However, as the gate line 21 is kept at "H", the TFT of the pixels of the third line at the right side of the screen is also turned ON and the video signals being held by the data line Xq of the right side of the screen are written for these pixels.

Originally, when writing the video signals from the sample-hold circuit SHp1 for the pixels at the left half of the screen, the video signals from the sample-hold circuit SHq1 must be written for the right half of the screen. However, as shown in FIGS. 5(*c*) through 5(*f*), the OE1, OE2, OE3 and OE4 signals become "1H" sequentially and if the OE1 signal is kept at "H", the video signals being held by the data line Xq for the right side of the screen are the signals read by the OE4 signals, that is, they are the video signals from the sample-hold circuit SHq2. In other words, when the video signals from the sample-hold circuit SHp1 are written for the pixels at the left side of the screen, the video signals of the preceding line from the sample-hold circuit SHq2 are written for the pixels at the right side of the screen. Then, when the data line Y22 becomes "H", the same signals as those for the pixels of the third lines at the right half of the screen are written for the pixels of the fourth line at the right half of the screen. That is, there was such a problem that the same video signals were written for the pixels of three lines at the right half of the screen and thus, the resolution was lowered and the display became unnatural.

On a conventional liquid crystal display driving system described above, there was such a problem that the same video was displayed on three lines at the right half of the screen by the floating capacitance of the data line, thus reducing the resolution and making the display unnatural.

SUMMARY OF THE INVENTION

It is, therefore, an object of the present invention to provide a liquid crystal display driving system which is capable of providing a sufficient time for writing video signals without increasing the circuit size and also is capable of improving resolution and providing a natural display.

In order to achieve the above object, a liquid crystal display driving system according to one aspect of the present invention includes a liquid crystal display unit which has a screen of matrix arrangement comprised of a plurality of pixels, data lines for driving the columns of the pixels and scanning signal lines for driving the rows of the pixels, a circuit for supplying video signal to the pixels through the data lines, a scanning signal line controller for supplying progressive scanning signal to the scanning signal lines, a first sample-hold circuit for holding video signals for the pixels corresponding to odd rows on a first half side of the screen and for supplying the held video signals to the data lines corresponding to the first half side on the screen based on a first output directing signal, a second sample-hold circuit for holding video signals for the pixels corresponding to even rows on the first half side of the screen and for supplying the held video signals to the data lines corresponding to the first half side on the screen based on a second output directing signal, a third sample-hold circuit for holding video signals for the pixels corresponding to odd rows on a second half side of the screen and for supplying the held video signals to the data lines corresponding to the second half side on the screen based on a third output directing signal and a fourth sample-hold circuit for holding video signals for the pixels corresponding to even rows on the second half side of the screen and for supplying the held video signals to the data lines corresponding to the second half side on the screen based on a second output directing signal.

In a liquid crystal display driving system according to another aspect of the present invention, the liquid crystal display unit has a screen of matrix arrangement comprised of a plurality of pixels, data lines for driving the columns of the pixels, a first set of scanning signal lines for driving the rows of the pixels on a first half side of the screen and a second set of scanning signal lines for driving the rows of the pixels on a second half side of the screen.

In a liquid crystal display driving system according to still another aspect of the present invention, the liquid crystal display unit has a screen of matrix arrangement comprised of a plurality of pixels, a first set of a prescribed scanning signal line and data lines for driving the pixels on a first half side of the screen and a second set of another scanning signal line next to the prescribed scanning signal line and data lines for driving the pixels on a second half side of the screen.

Thus, in the present invention, the first and the second sample-hold means sample and hold the video signals corresponding to the pixels at the first half side of the screen in the first half of the horizontal scanning period, while the third and the fourth sample-hold means sample and hold the video signals corresponding to the pixels at the second half side of the screen in the latter half of the horizontal scanning period. After the respective sampling and holding operations, the first through the fourth output directing signals are generated, the video signals being held by the first through the fourth sample-hold means are applied to the data lines and held in the floating capacitance of the data lines and are written for the pixels. The timings for generating the first through the fourth output directing signals and the scanning signals are properly set to prevent the same video signals from being written into two lines.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily appreciated as the same becomes better understood by reference to the following detailed description when considered in connection with the accompanying drawings, wherein.

DESCRIPTION OF THE PREFERRED EMBODIMENTS

Figure 1:
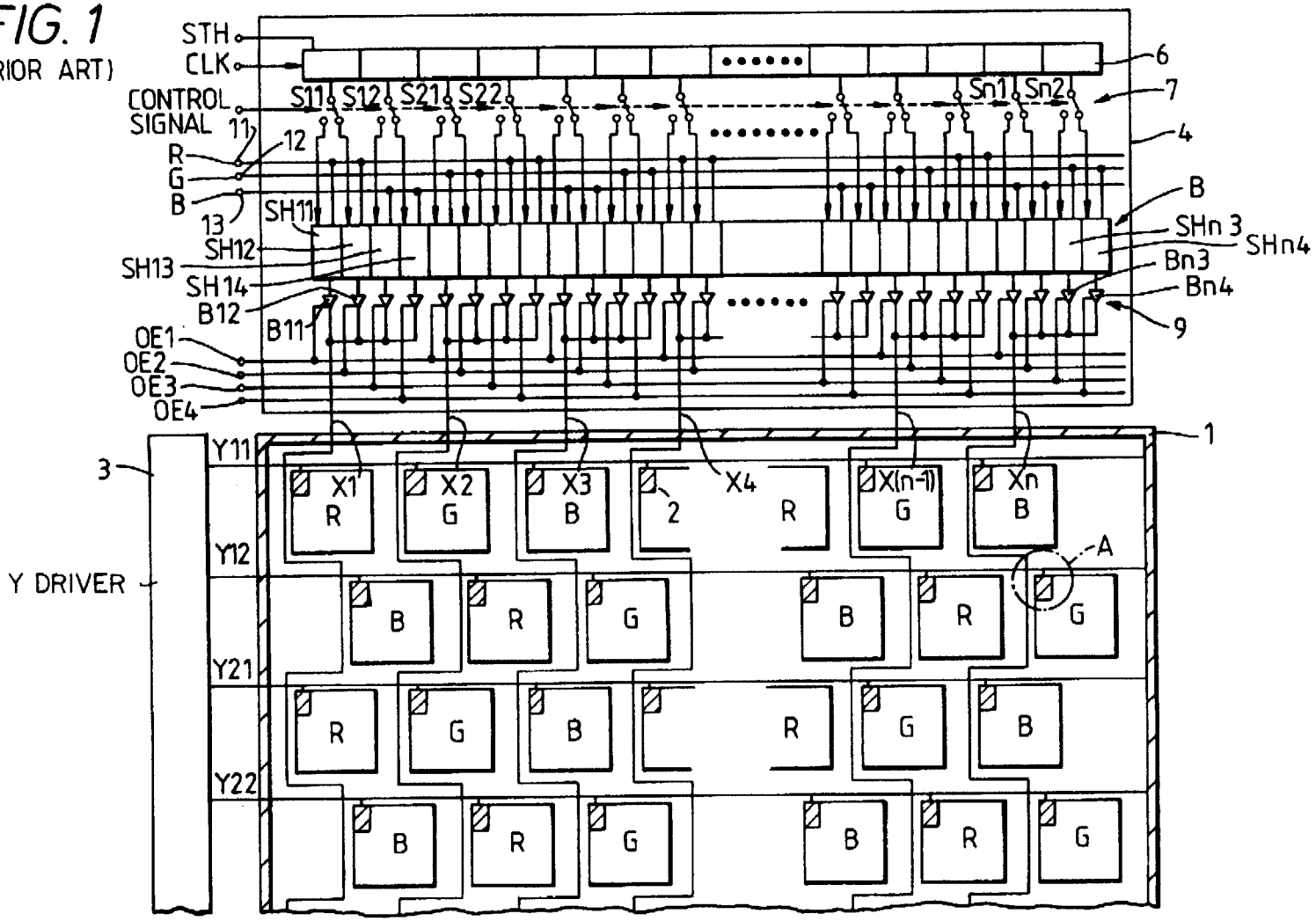
FIG. 1 (PRIOR ART)
FIG. 1 is an explanatory diagram showing a conventional liquid crystal display driving system.
Figure 2:
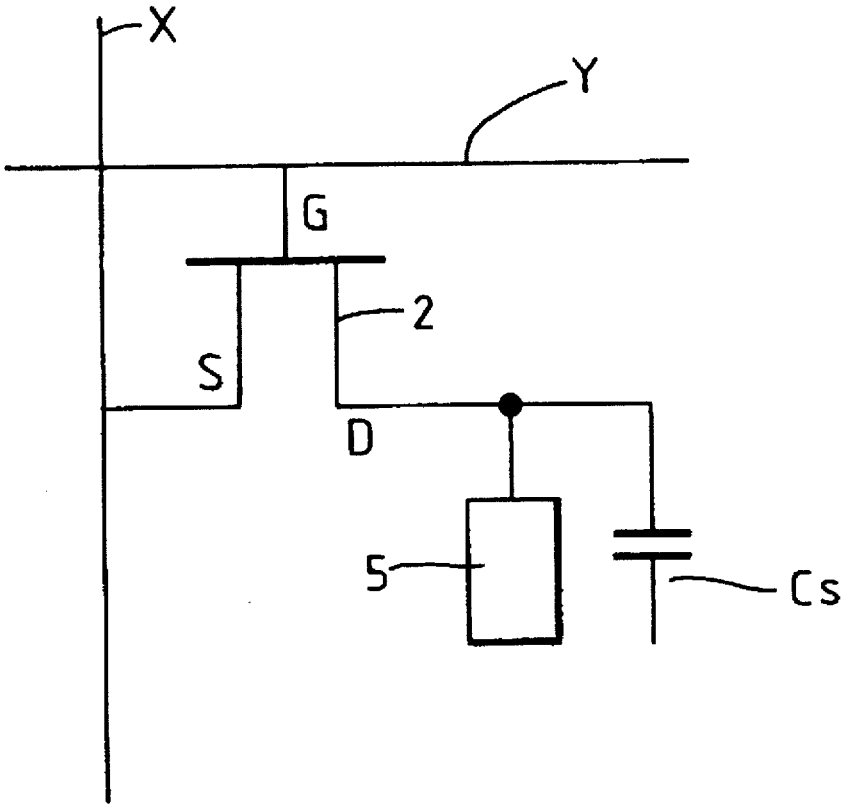
FIG. 2 (PRIOR ART)
FIG. 2 is an explanatory diagram showing Section A of FIG. 1.
Figure 3:
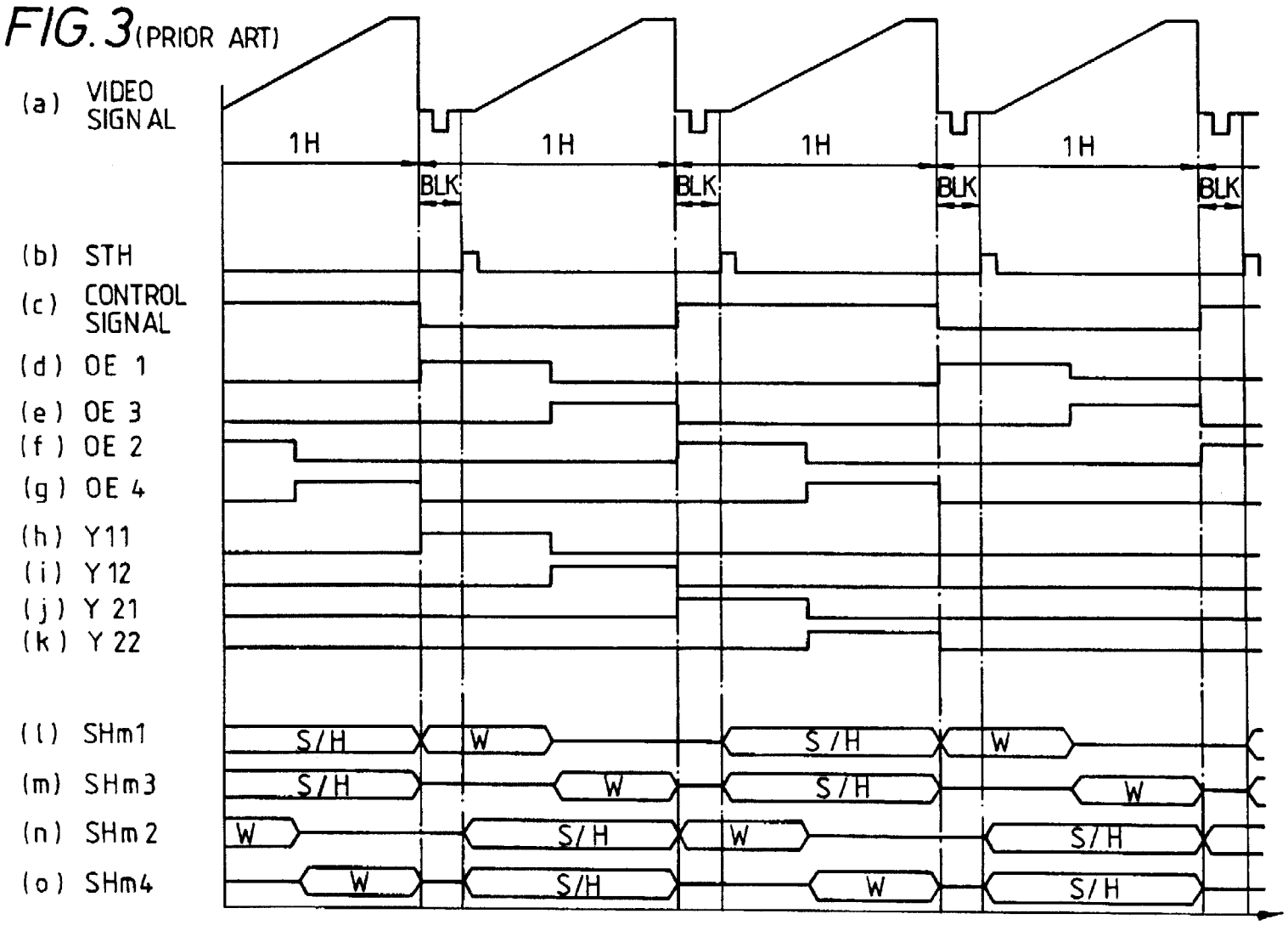
FIG. 3 (PRIOR ART)
FIG. 3 is a timing chart for explaining the operation of an embodiment of the conventional liquid crystal display driving system.
Figure 4:
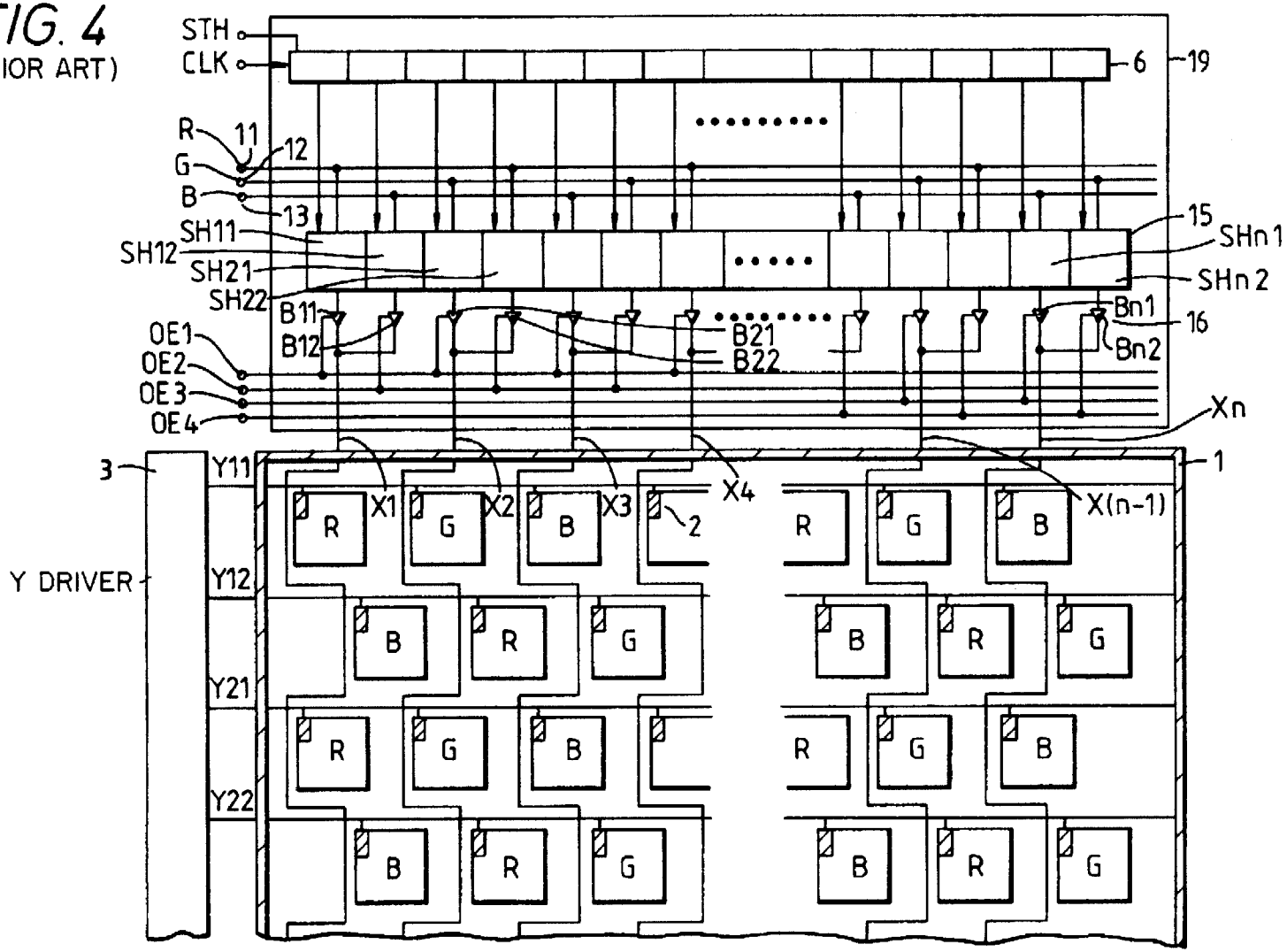
FIG. 4 (PRIOR ART)
FIG. 4 is an explanatory diagram showing another embodiment of the conventional liquid crystal display driving system.

The present invention will be described in detail with reference to FIGS. 6 through 12. Throughout the drawings, reference numerals or letters used in FIGS. 1 through 5 will be used to designate like or equivalent elements for simplicity of explanation.

Figure 6:
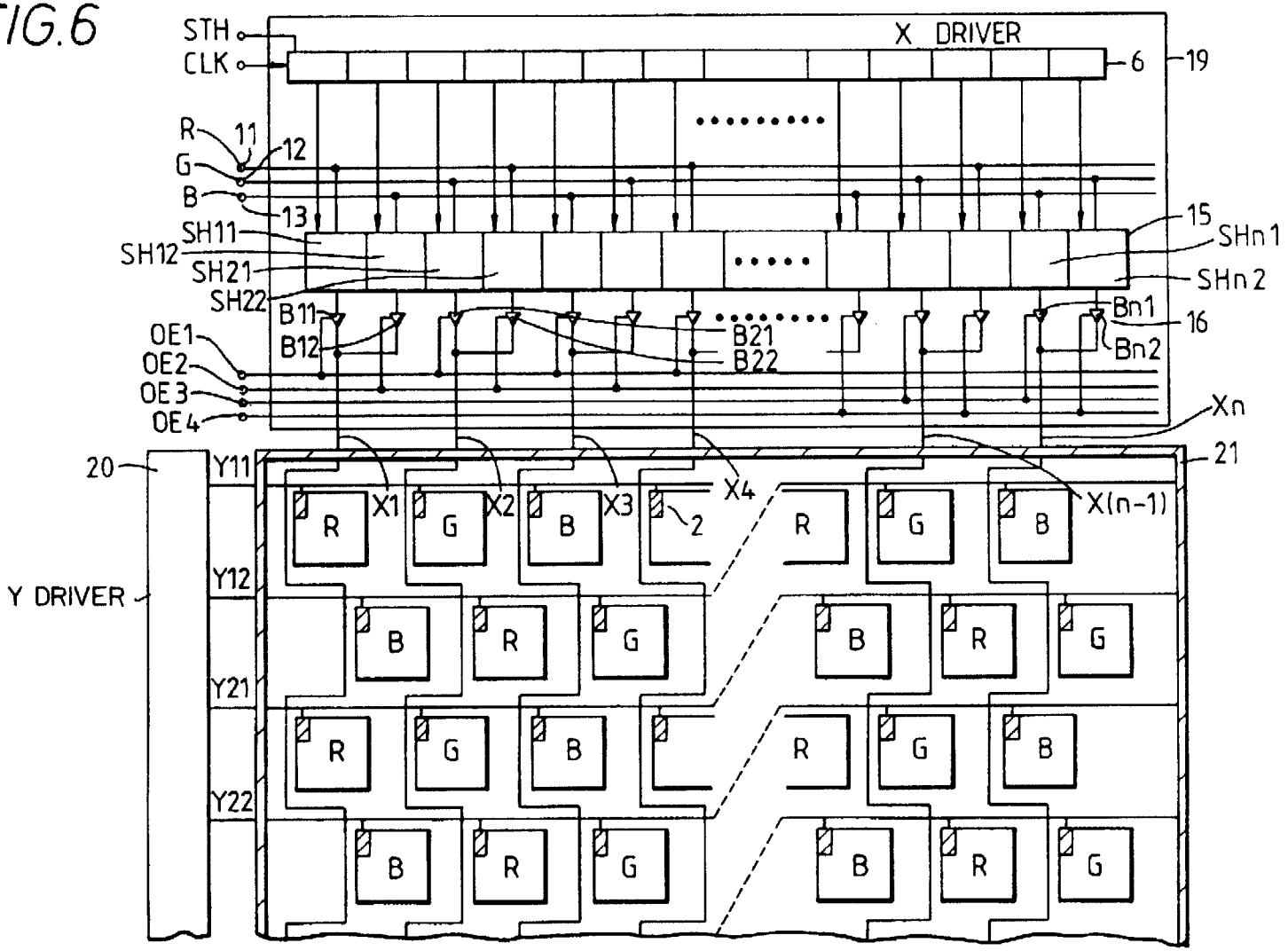
FIG. 6 is an explanatory diagram showing the first embodiment of the liquid crystal display driving system of the present invention.
Figure 7:
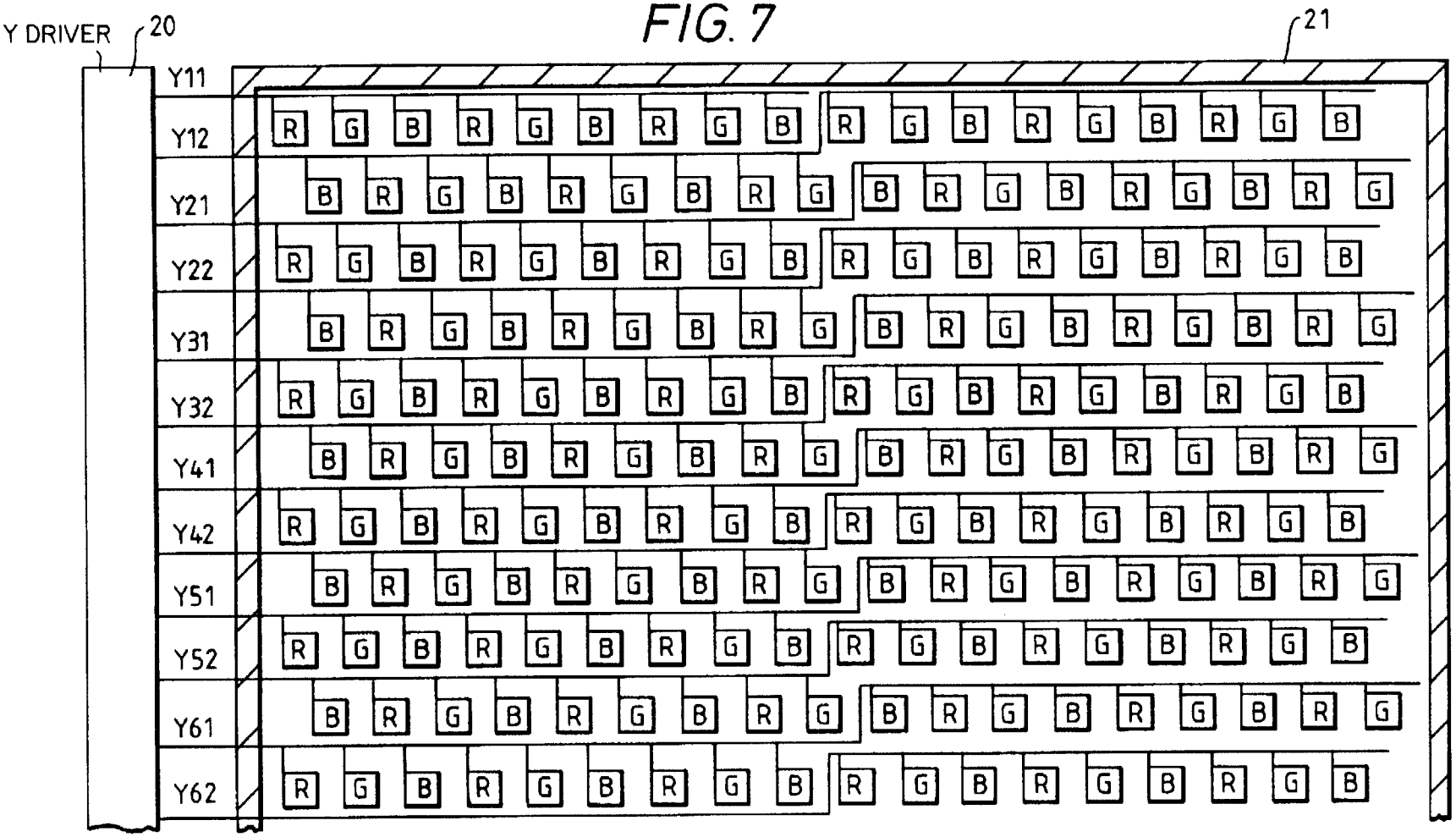
FIG. 7 is an explanatory diagram showing the liquid crystal cell 21, as shown in FIG. 6.
Figure 8:
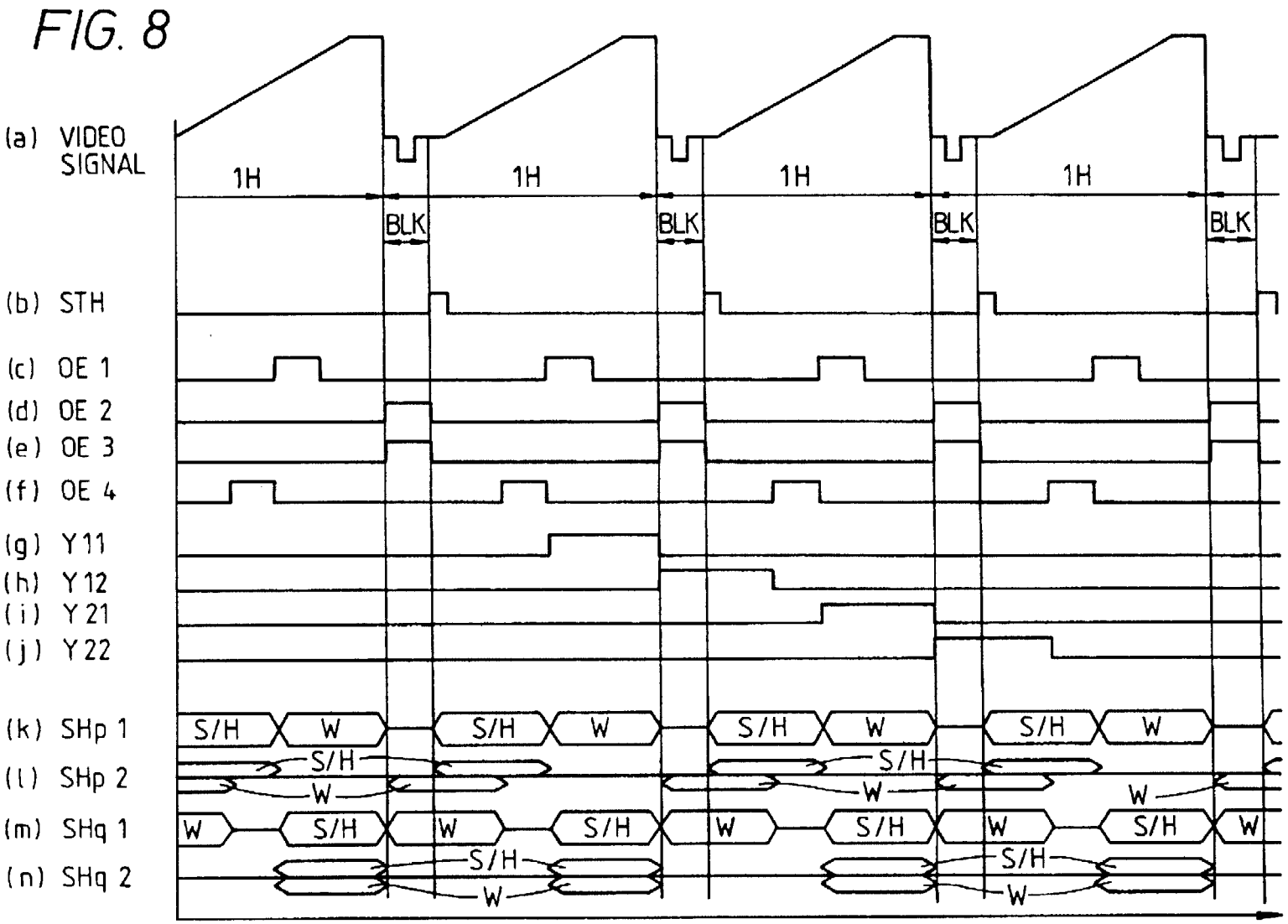
FIG. 8 is a timing chart for explaining the operation of the first embodiment.

Referring now to FIGS. 6, 7 and 8, a first embodiment of the liquid crystal display driving system according to the present invention will be described in detail.

FIG. 6 is an explanatory diagram showing the first embodiment of the liquid crystal display driving system of the present invention. In FIG. 6, an X driver 19 comprises a shift register 6, a sample-hold circuit group 15 and a buffer amplifier group 16. The shift register 6 has a number of bits twice as large as the number of pixels in the horizontal direction and takes in a start signal which is generated at the start timing of the horizontal scanning period and frequency clock CLK which is based on twice the number of pixels in the horizontal direction. The shift register 6 starts to output an ON pulse from the start signal and shifts the ON pulse output bits by one bit at a time in synchronism with the clock signal CLK. The ON pulse from each bit of the shift register 6 is applied to the sample-hold circuit SH (SH11, SH12, SH21, SH22, . . . SHn1, SHn2) of the sample-hold circuit group 15. The sample-hold circuits SH11, SH12, SH21, SH22, . . . , SHn1, SHn2 are applied with color signals R, B, G, R, . . . and sample and hold these color signals at the timing of the ON pulse from the shift register 6.

The outputs of the sample-hold circuits SH11, SH12, SH21, SH22, . . . SHn1, SHn2 are applied to the buffer amplifiers B11, B12, B21, B22, . . . , Bn1, Bn2, respectively. The buffer amplifiers Bp1 and Bp2 (p=1, 2, . . . n/2) are applied with the OE1 signal or the OE2 signal, respectively, and are turned ON when the OE1 or the OE2 signal becomes "H" and apply the outputs of the sample-hold circuits SHp1 and SHp2 to the data lines Xp corresponding to the first half side, e.g., the left side of the liquid crystal cell 21. Further, the buffer amplifiers Bq2 and Bq2 (q=n/2+1, . . . n) are applied with the OE3 signal or the OE4 signal, respectively, and are turned ON when the OE3 or the OE4 signal becomes "H" and apply the outputs of the sample-hold circuits SHq1 and SHq2 to the data lines Xp corresponding to the second half side, e.g., the right side of the liquid crystal cell 21.

A Y driver 20 has output terminals corresponding to the number of pixels in the vertical direction of the liquid crystal cell 21, and these output terminals are connected to the gate lines Y11, Y12, Y21, Y22, . . . of the liquid crystal cell 21. The Y driver 20 puts the output terminal connected to the gate line Y11 to the "H" level by a timing signal showing the start of the vertical scanning period and thereafter, by shifting the output terminals to make them "H" sequentially in the ½ horizontal period, applies the "H" level gate signal to all gate lines Y in one vertical scanning period.

FIG. 7 is an explanatory diagram for explaining the arrangement of the pixels of the liquid crystal cell 21, as shown in FIG. 6.

The liquid crystal cell 21 has adopted to the delta arrangement where the odd line pixels and the even line pixels are shifted each other by half pixels in the horizontal direction. The color filters (not shown) are arranged in order of R, G, B, R, . . . for the odd lines, while they are arrange in order of B, R, G, B, . . . for the even lines. The pixels of the first row of these lines are connected to the data lines X1 and similarly, the pixels of the m th row (m=1, 2, . . . , n) are connected to the data lines Xm (see FIG. 6).

In this embodiment, the gate lines connected to the pixels at the left half of the liquid crystal 21 and the gate lines connected to the pixels at the right half are staggered relative to each other by one line. That is, the pixels connected to the left half data lines Xp of the first line are connected to the gate lines Y11, while the pixels connected to the right half data lines Xq are connected to the gate lines Y12. Further, the pixels connected to the left half data lines Xp of the second line are connected to the gate lines Y12, while the pixels connected to the right half data lines Xq are connected to the data lines Y21. Thereafter, similarly, the pixels connected to the left half data lines Xp of the line J (j=1, 2, . . .) are connected to the gate lines Yj1, while the pixels connected to the right half data lines Xq are connected to the gate line Yj2.

Next, the operation of this embodiment in the construction described above will be explained with reference to the timing chart, as shown in FIG. 8. FIG. 8(*a*) illustrates the video signal, FIG. 8(*b*) illustrates the start signal STH, FIG. 8(*c*) through 8(*f*) illustrate the OE1, OE2, OE3 and OE4 signals, FIGS. 8(*g*) through 8(*j*) illustrate the gate signals applied to the gate lines Y11, Y12, and Y22, FIGS. 8(*k*) and 8(*l*) illustrate the operations of the sample-hold circuits SHp1 and SHp2, respectively, FIGS. 8(*m*) and 8(*n*) illustrate the operations of the sample-hold circuits SHq1 and SHq2, respectively. In FIG. 8, S/H indicates the sample-hold operation and W indicates the write operation to the pixels.

As shown in FIGS. 8(*a*) and 8(*b*), if the start signal is input to the shift register 6 at the start timing of the period for horizontal scanning of video signals, the shift register 6 shifts the ON pulse and applies it to the sample-hold circuit SH. The sample-hold circuits SHp1 and SHp2 (p=1, 2, . . . n/2) sample and hold the video signals R, G and B sequentially (FIGS. 8(*k*), 8(*l*)). When the video signals are held by the sample-hold circuits SHp1 and SHp2 after a period of H/2 has passed, as shown in FIGS. 8(*c*) and 8(*g*), the OE1 signal and the gate line Y11 become "H" and the video signals held in the sample-hold circuit SHp1 are applied to the data line Xp through the buffer amplifier Bp1 (FIG. 8(*k*)). The OE1 signal becomes "H" for a time nearly equal to the horizontal blanking period (BLK), while the video signals are written in the floating capacitance of the data line Xp. While the gate line Y11 is kept at "H" (about half of horizontal scanning period), the video signals from the data line Xp are written for the left half pixels of the first line connected to the gate line Y11. After the OE1 signal becomes "L", the video signals being held in the floating capacitance of the data line Xp are continuously written as long as the gate line Y11 is kept at "H".

If the gate line Y11 becomes "L" at the end of the horizontal scanning period, the OE2 signal becomes "H" in the horizontal blanking period (FIG. 8(*d*)). As a result, the sample-hold circuit SHp2 applies the holding video signals to the data line Xp through the buffer amplifier Bp2. During this horizontal blanking period, the gate line Y12 also becomes "H", as shown in FIG. 8(*h*) and the video signals applied to the data line Xp are written for the pixels at the left side of the second line. When the blanking period ends, the OE2 signal becomes "L" and the sample-hold circuit SHp2 holds the video signals in the first half of the horizontal scanning period. On the other hand, the gate line Y12 is kept at "H" during about half of the horizontal scanning period. Therefore, the video signals being kept by the floating capacitance of the data line Xp are continuously written.

On the other hand, in the latter half of the horizontal scanning period, the color signals R, G and B are sampled and held by the sample-hold circuits SHq1 and SHq2. In the horizontal blanking period, the OE2 as well as the OE3 signals become "H" (FIG. 8(*e*)). As a result, the sample-hold circuit SHq1 applies the holding video signals to the data line Xq to hold them in its floating capacitance, and then the video signals are written to the left half pixels as well as the right half pixels connected to the gate line Y12 simultaneously.

Figure 5:
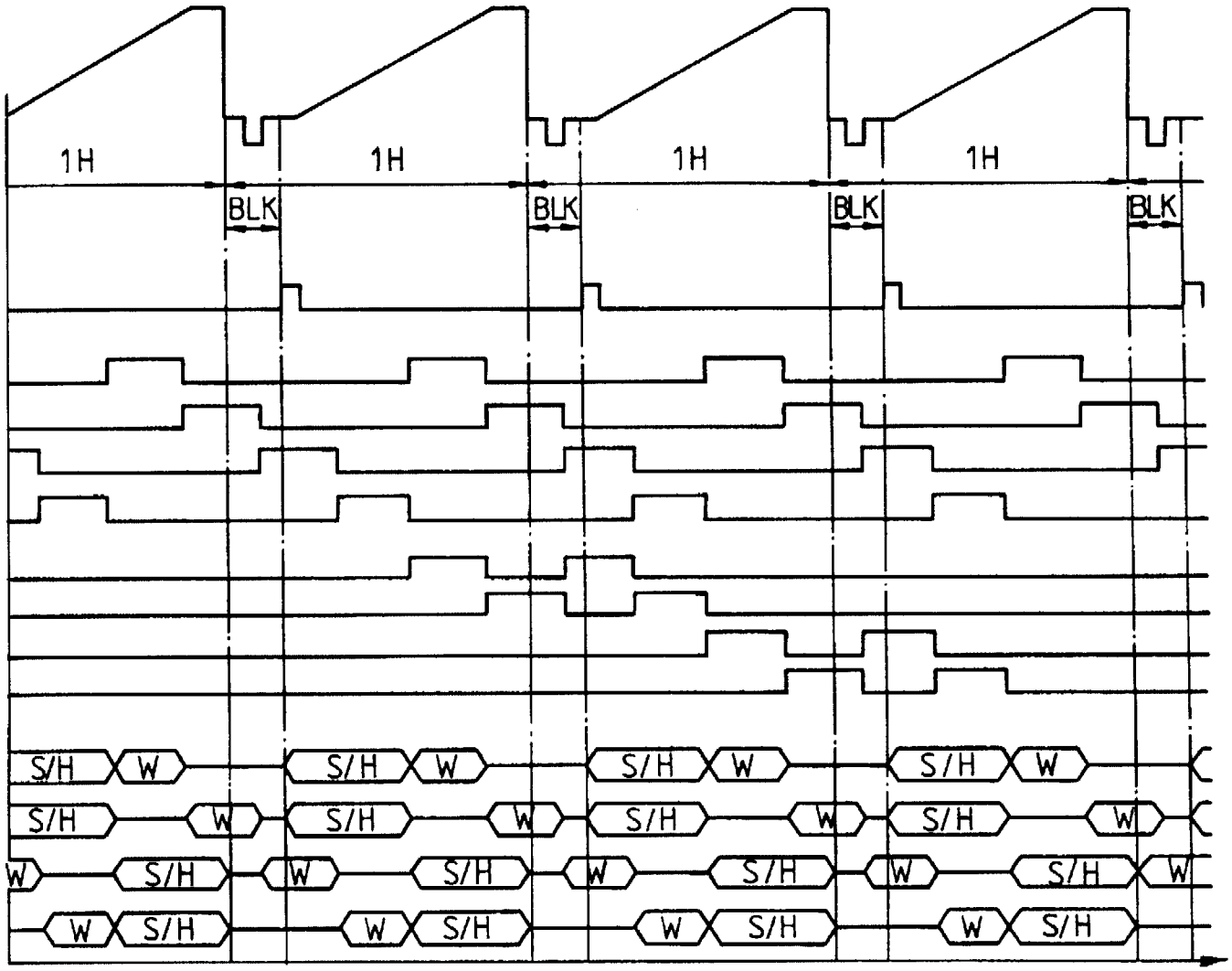
FIG. 5 (PRIOR ART)
FIG. 5 is a timing chart for explaining the operation of the embodiment of the conventional liquid crystal display driving system.

As shown in FIGS. 5(*f*) and 5(*h*), if the gate line Y12 becomes "L", the OE4 signal becomes "H" in the first half of the horizontal scanning period for about the same time as in the horizontal blanking period. During the period when the OE4 signal is "H", the gate line Y21 is kept at "L". Therefore, the video signals for the even lines being held by the data line Xp will never be written for the left half pixels connected to the gate line Y21. If the OE4 signal becomes "L", the gate line Y21 becomes "H1" only for the ½ horizontal scanning period and the video signals of the even lines being held in the floating capacitance of the data line Xq are written for the right half pixels together with the video signals of the odd lines applied to the data line Xp. Thereafter, the same operation is carried out repeatedly.

Thus, in this embodiment, the gate lines which are connected to the left half pixels and the right half pixels on the screen are staggered by one line, and the video signals are written for the left half pixels during the period when the video signals corresponding to the right half pixels are sampled and held, while the video signals are written for the right half pixels during the period when the video signals corresponding to the left half pixels are sampled and held, and the sample-hold operation of the sample-hold circuits and the write for the pixels are staggered by using the floating capacitance of the data lines so that the video signals of the preceding line being held in the floating capacitance of the data lines are prevented from being written for the pixels of the next lines.

Further, in this embodiment the shift register 1 has a number of bits which is twice as large as the number of pixels per line but two registers, each of which has the same number of bits as the number of pixels per line, may be used to output ON pulses by providing operating clock signals whose phases differ by 180 degrees relative to each other to these registers at a frequency corresponding to the number of pixels per line. Further, the sample-hold circuit group 15 may be divided into two groups of SH11, SH21, . . . SHn1 and SH12, SH22, . . . SHn2 to correspond to the left half and the right half of the screen, respectively. Further, the OE2 and the OE3 signals are commonly used and three kinds of OE signals may be used.

Figure 9:
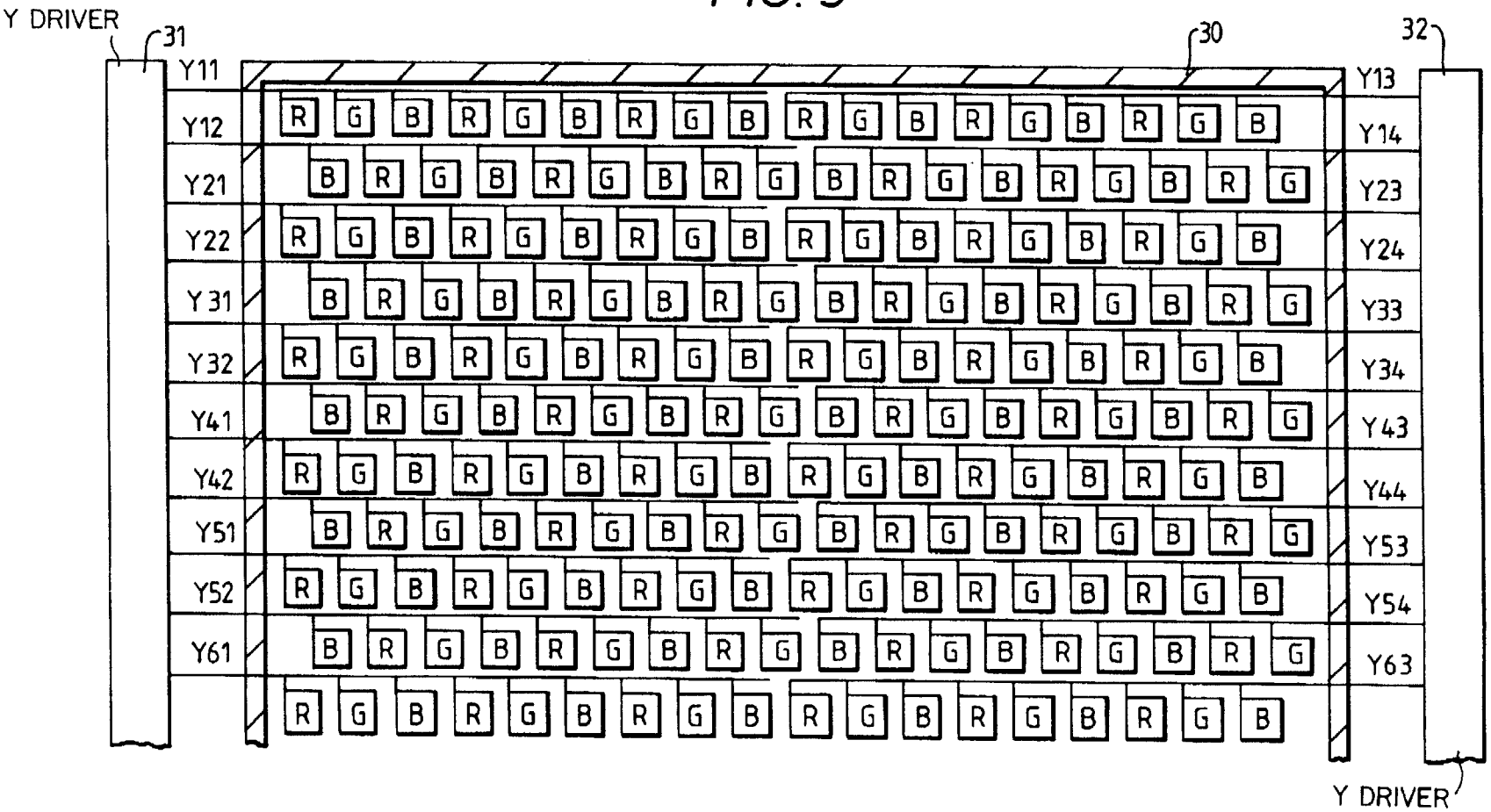
FIG. 9 is an explanatory diagram showing the second embodiment of the present invention.

FIG. 9 is an explanatory diagram for explaining a second embodiment of the present invention.

This embodiment differs from the first embodiment shown in FIG. 6 in that this embodiment uses a liquid crystal cell 30 for the liquid crystal cell 21 and two Y drivers 31 and 32 for the Y driver 20. The liquid crystal cell 30 has adopted the delta arrangement using color filters and the pixels of the first through the n the rows are connected to the data lines X1 through Xn (not shown). The pixels of the left half lines of the liquid crystal cell 30 are connected to the gate lines Y11, Y12, Y21, Y22, . . . and the pixels of the right half lines are connected to the gate lines Y13, Y14, Y23, Y24, . . . The Y driver 31 applies the "H" gate signal to the gate lines Y11, Y12, Y21, Y22, . . . sequentially and the Y driver 32 applies the "H" gate signals to the gate lines Y13, Y14, Y23, Y24, . . . sequentially.

Figure 10:
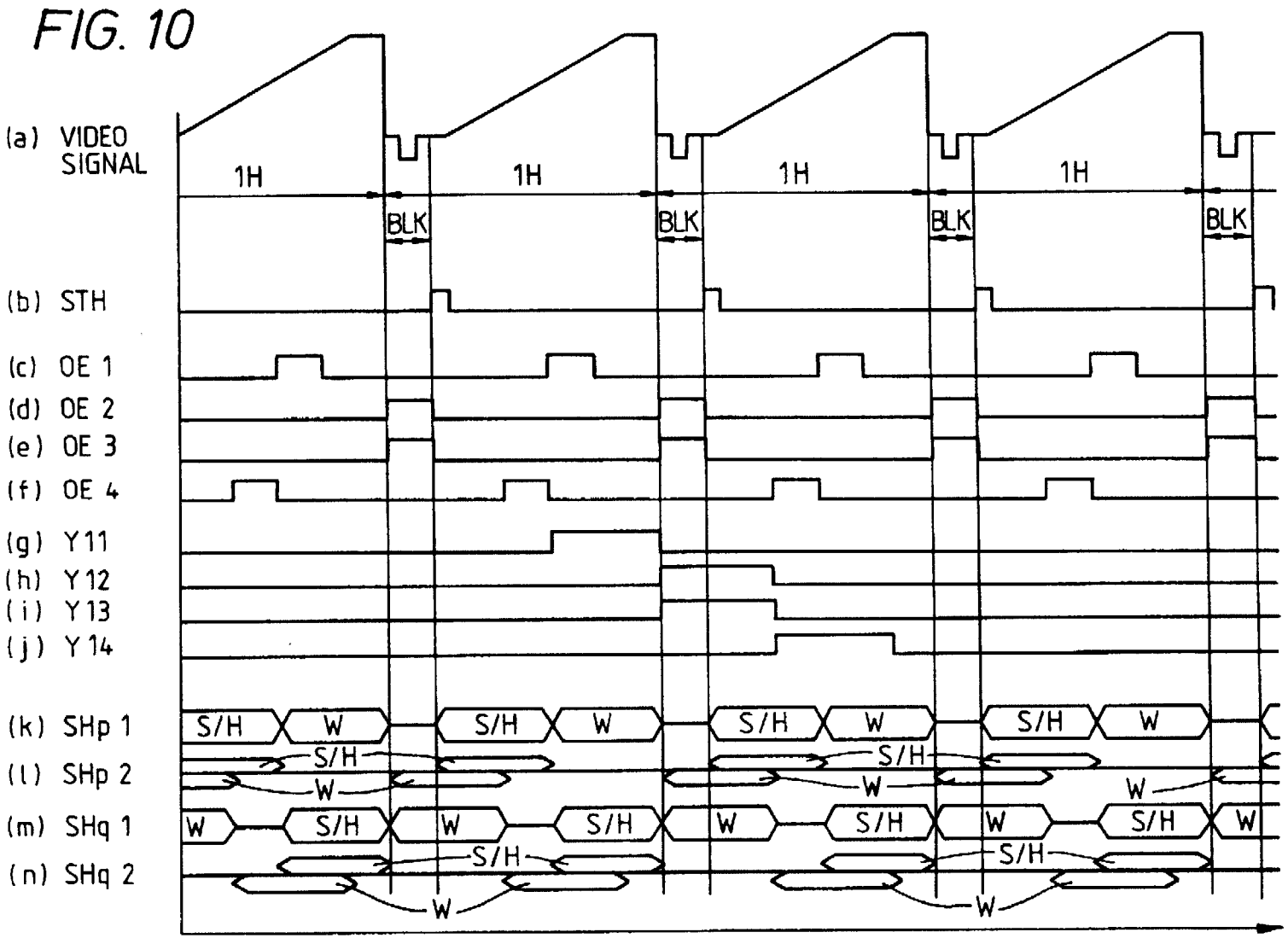
FIG. 10 is a timing chart for explaining the operation of the second embodiment shown in FIG. 9.

Next the operation of the second embodiment described above will be explained with reference to the timing chart shown in FIG. 10. FIG. 10(*a*) illustrates the video signal, FIG. 10(*b*) illustrates the start signal STH, FIGS. 10(*c*) through 10(*f*) illustrate the OE1 through OE4 signals, respectively, FIGS. 10(*g*) through 10(*j*) illustrate the gate lines Y11, Y12, Y23, and Y14, respectively, FIGS. 10(*k*) through 10(*l*) illustrate the sample-hold circuits SHp1 and SHp2, respectively and FIGS. 10(*m*) and 10(*n*) illustrate the sample-hold circuits SHq1 and SHq2, respectively.

In this embodiment, the gate lines Y12 and Y13 have changed similarly. Further, the changes of the OE1, OE2 and OE3 signals and the gate lines Y11 and Y12 are the same as those in the first embodiment shown in FIG. 1. The sample-hold and write operations of the video signals to the left half pixels and the right half pixels of the screen are the same as the first embodiment shown in FIG. 6. The gate line Y14 becomes "H" simultaneously when the OE4 signal becomes "H". In this embodiment, the right half pixels and the left half pixels of the screen are driven by different gate lines. Therefore, even if the writing of video signals for the pixels for the even lines at the right half of the screen is started when the OE4 signal becomes "H", the video signals which are to be written for the preceding line will never be written for the pixels of the odd lines at the left half of the screen.

Other operations and effects are the same as the first embodiment shown in FIG. 6.

Figure 11:
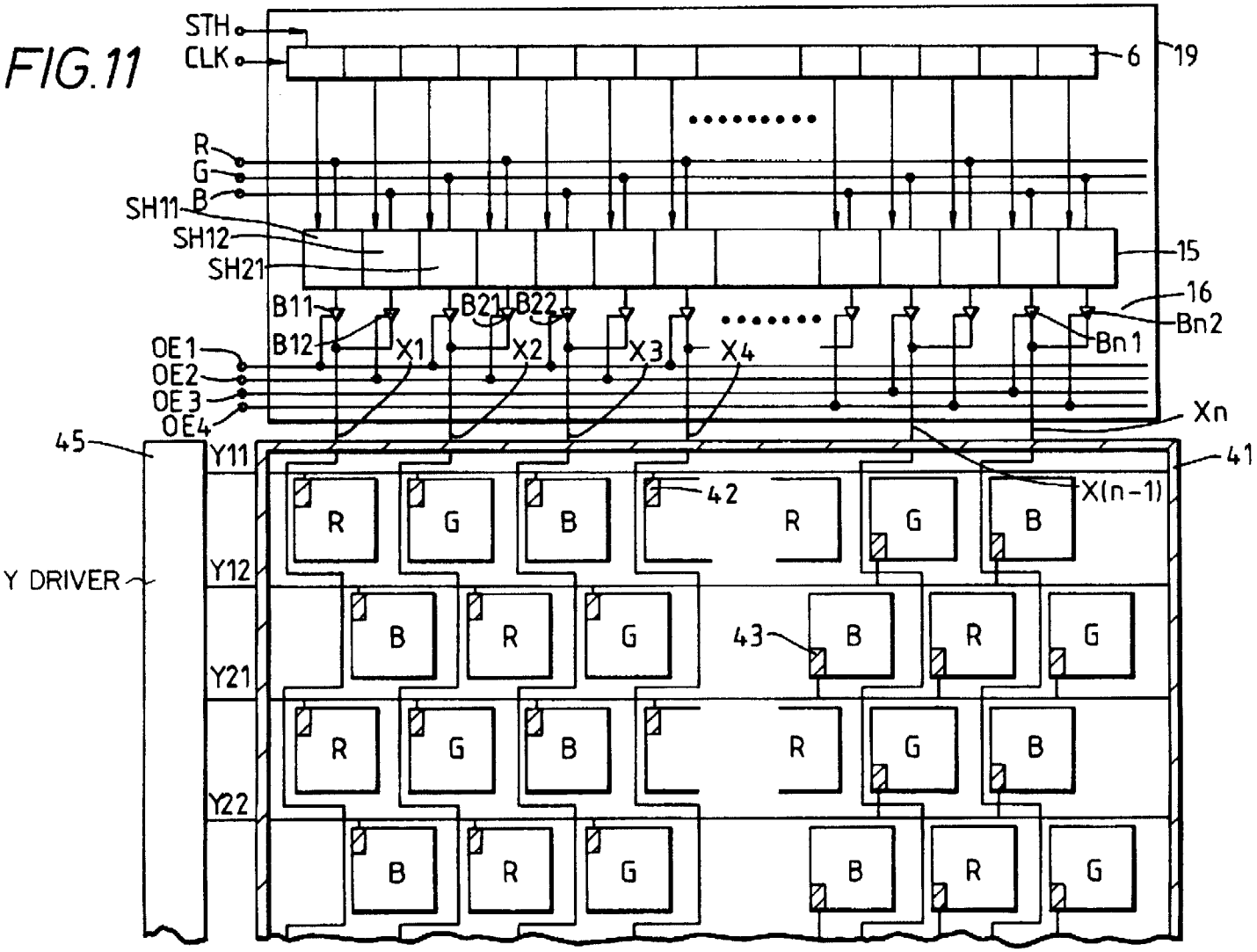
FIG. 11 is an explanatory diagram showing the third embodiment of the present invention.
Figure 12:
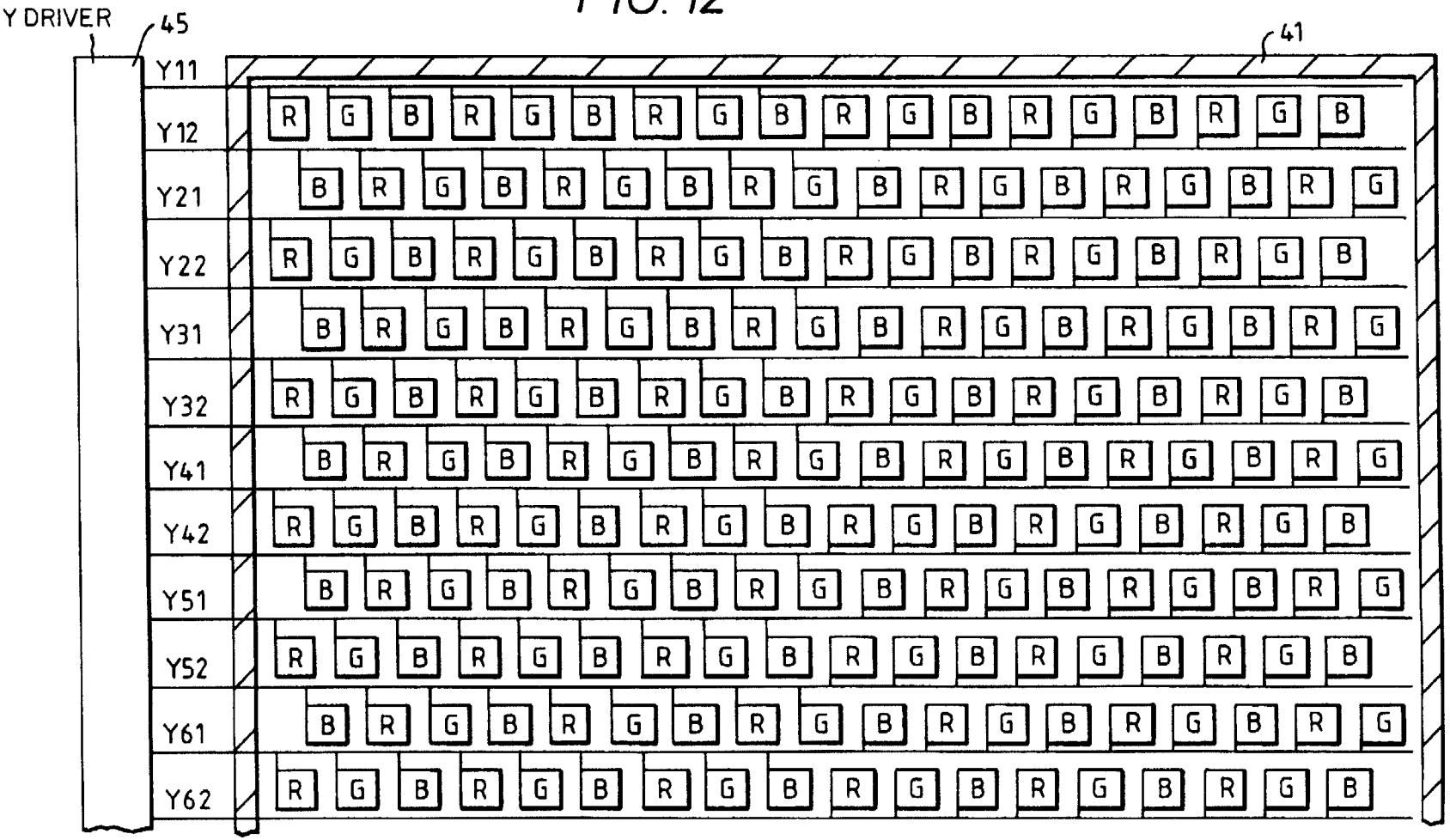
FIG. 12 is an explanatory diagram showing the liquid crystal cell and the Y driver in the third embodiment shown in FIG. 11.

FIGS. 11 and 12 are explanatory diagrams for explaining the third embodiment of the present invention.

In this embodiment, the construction of a liquid crystal cell differs from the first embodiment shown in FIG. 6. As shown in FIGS. 11 and 12, a liquid crystal cell 41 has adopted the delta arrangement and the data lines X1 through Xn are connected to the pixels of the first through the n th rows. A TFT 42 is formed for the left half pixels of the liquid crystal cell 41 and a TFT 43 is formed for the right half pixels. The gates of TFT 42 of the odd lines are connected to the gate lines Yj1 (j=1, 2, . . . ) and the gates of TFT 42 of the even lines are connected to the gate lines Yj2. Further, the gates of TFT 43 of the odd lines are connected to the gate lines Yj2 and the gates of TFT 43 of the even lines are connected to the gate lines Y(j+1)1. That is, the left half pixels and the right half pixels of the screen are driven by the gate lines which are staggered by one line. A Y driver 45 supplies the "H" level gate signal to the gate lines Y11 and Y12, sequentially.

In the embodiment in the construction as described above, the same scanning as in the first embodiment can be carried out. That is, the operation will be the same as that shown in the timing chart in FIG. 8 and the same effect as in the first embodiment shown in FIG. 6 can be obtained.

The present invention is not limited to the embodiments described above. The liquid crystal display panel of the delta arrangement having color filters was explained in the embodiments described above. However, it is also possible to apply the present invention to a liquid crystal display panel of the delta arrangement for a monochromatic display. Further, it is also effective if the arrangement of color filters differs for odd lines and even lines when the present invention is applied to a liquid crystal display panel of the grid arrangement, which is provided with color filters.

As described above, the present invention can provide an extremely preferable liquid crystal display driving system. That is, the liquid crystal display driving system according to the present invention has such an effect that a sufficient write time is obtained without increasing the circuit size, and resolution can be improved, thus providing a natural display.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt the teaching of the present invention to a particular situation of material without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. A liquid crystal display driving system comprising:

a liquid crystal display unit which has a screen of matrix arrangement comprised of a plurality of pixels arranged in a plurality of rows and columns relative to the display unit, data lines for driving columns of the pixels, and scanning signal lines for driving rows of the pixels;

means for supplying video signals to the pixels through the data lines;

directing signal generating means for generating first, second, third and fourth output directing signals;

scanning signal line control means for supplying a progressive scanning signal to the scanning signal lines, where the progressive scanning signal is a periodic signal having a frequency lower than that of each of the first, second, third and fourth output directing signals;

first sample-hold means for holding first video signals for pixels corresponding to only odd rows on a first side of the screen and for supplying the first held video signals to data lines corresponding to the first side of the screen based on the first output directing signal;

second sample-hold means for holding second video signals for pixels corresponding to only even rows on the first side of the screen and for supplying the second held video signals to data lines corresponding to the first side of the screen based on the second output directing signal;

third sample-hold means for holding third video signals for pixels corresponding to only odd rows on a second side of the screen and for supplying the third held video signals to data lines corresponding to the second side of the screen based on the third output directing signal; and fourth sample-hold means for holding fourth video signals for pixels corresponding to only even rows on the second side of the screen and for supplying the third held video signals to data lines corresponding to the second side of the screen based on the fourth output directing signal.

2. The system of claim 1, wherein:

the pixels are in a delta configuration.

3. The system of claim 1, wherein:

the pixels include red-filtered pixels, blue-filtered pixels, and green-filtered types of pixels; and each of the data lines is connected to more than one of the types of pixels.

4. The system of claim 3, wherein:

each of the data lines is connected to exactly two of the types of pixels.

5. The system of claim 1, wherein:

the plurality of the scanning signal lines include a plurality of even scanning signal lines and a plurality of odd scanning signal lines;

a first side of each odd row of pixels is connected only to one of the odd scanning signal lines;

a second side of each odd row of pixels is connected only to one of the even scanning signal lines;

a first side of each even row of pixels is connected only to one of the even scanning signal lines; and a second side of each even row of pixels is connected only to one of the odd scanning signal lines.

6. The system of claim 5, wherein:

at least one of the scanning signal lines is connected to a first side of a first row of pixels and a second side of a second row of pixels, where the second row of pixels precedes the first row of pixels in an order of scanning by the progressive scanning signal.

7. The system of claim 1, wherein the same scanning signal line drives rows of pixels in both the first side and the second side of the screen.

8. The system of claim 1, wherein the same scanning signal line drives the same row of pixels in both the first side and the second side of the screen.

9. The system of claim 1, wherein the same scanning signal line drives different rows of pixels in the first side and the second side of the screen.

10. A crystal display driving system comprising:

a liquid crystal display unit which has a screen of matrix arrangement comprised of a plurality of pixels, data lines for driving columns of the pixels, a first set of scanning signal lines for driving rows of pixels on a first side of the screen and a second set of scanning signal lines for driving rows of pixels on a second side of the screen;

means for supplying video signals to the pixels through the data lines;

directing signal generating means for generating first, second, third and fourth output directing signals;

scanning signal line control means for supplying progressive scanning signal to the scanning signal lines, where the progressive scanning signal is a periodic signal having a frequency lower than that of each of the first, second, third and fourth output directing signals;

first sample-hold means for holding first video signals for pixels corresponding to only odd rows on a first side of the screen and for supplying the first held video signals to data lines corresponding to the first side of the screen based on the first output directing signal;

second sample-hold means for holding second video signals for pixels corresponding to only even rows on the first side of the screen and for supplying the second held video signals to data lines corresponding to the first side of the screen based on the second output directing signal;

third sample-hold means for holding third video signals for the pixels corresponding to only odd rows on a second side of the screen and for supplying the third held video signals to data lines corresponding to the second side of the screen based on the third output directing signal; and fourth sample-hold means for holding fourth video signals for pixels corresponding to only even rows on the second side of the screen and for supplying the fourth held video signals to data lines corresponding to the second side of the screen based on the fourth output directing signal.

11. The system of claim 10, wherein:

the pixels are in a delta configuration.

12. The system of claim 10, wherein:

the pixels include red-filtered pixels, blue-filtered pixels, and green-filtered types of pixels; and each of the data lines is connected to more than one of the types of pixels.

13. The system of claim 12, wherein:

each of the data lines is connected to exactly two of the types of pixels.

14. The system of claim 10, wherein:

the first set of scanning signal lines and the second set of scanning signal lines are separate from one another.

15. The system of claim 10, wherein:

each of the first and second sets of scanning signal lines have, for each of the rows of pixels, a scanning signal line corresponding thereto.

16. The system of claim 15, wherein:

the scanning signal lines in the first and second sets of scanning signal lines corresponding to a given row of pixels are separate from one another.

17. The system of claim 10, the scanning signal control line means comprising:

a first scanning signal generation means for providing a scanning signal to the first set of scanning signal lines; and a second scanning signal generation means for providing a scanning signal to the second set of scanning signal lines.

18. The system of claim 10, wherein the same scanning signal line drives rows of pixels in both the first side and the second side of the screen.

19. The system of claim 10, wherein the same scanning signal line drives the same row of pixels in both the first side and the second side of the screen.

20. The system of claim 10, wherein the same scanning signal line drives different rows of pixels in the first side and the second side of the screen.

21. A liquid crystal display driving system comprising:

a liquid crystal display unit which has a screen of matrix arrangement comprised of a plurality of pixels, data lines for driving columns of the pixels and m+1 scanning signal lines for driving m+1 rows of the pixels, where each row of pixels includes a first part and a second part, each pixel in the first part of the mth row being connected to the mth scanning signal line, and each pixel in the second part of the mth row being connected to the (m+1)th or (m−1)th scanning signal line, where m is a natural number;

means for supplying video signals to the pixels through the data lines;

directing signal generating means for generating first, second, third and fourth output directing signals;

scanning signal line control means for supplying progressive scanning signal to the scanning signal lines, where the progressive scanning signal is a periodic signal having a frequency lower than that of each of the first, second, third and fourth output directing signals;

first sample-hold means for holding first video signals for pixels corresponding to only odd rows on a first side of the screen and for supplying the first held video signals to data lines corresponding to the first side on the screen based on the first output directing signal;

second sample-hold means for holding second video signals for pixels corresponding to only even rows on the first side of the screen and for supplying the second held video signals to data lines corresponding to the first side on the screen based on the second output directing signal;

third sample-hold means for holding third video signals for pixels corresponding to only odd rows on a second side of the screen and for supplying the third held video signals to data lines corresponding to the second side on the screen based on the third output directing signal; and fourth sample-hold means for holding fourth video signals for pixels corresponding to only even rows on the second side of the screen and for supplying the fourth held video signals to data lines corresponding to the second side on the screen based on the fourth output directing signal.

22. The system of claim 21, wherein:

the pixels are in a delta configuration.

23. The system of claim 21, wherein:

the pixels include red-filtered pixels, blue-filtered pixels, and green-filtered types of pixels; and each of the data lines is connected to more than one of the types of pixels.

24. The system of claim 23, wherein:

each of the data lines is connected to exactly two of the types of pixels.

25. The system of claim 21, wherein:

the m+1 scanning signal lines include a plurality of even scanning signal lines and a plurality of odd scanning signal lines;

a first side of each odd row of pixels is connected to one of the odd scanning signal line;

a second side of each odd row of pixels is connected to one of the even scanning signal line;

a first side of each even row of pixels is connected to one of the even scanning signal line; and a second side of each even row of pixels is connected to one of the odd scanning signal line.

26. The system of claim 25, wherein:

the second side of each odd row of pixels is connected to a next even scanning signal line, in an order of scanning by the progressive scanning signal, following the odd scanning signal line connected to the first side of that odd row of pixels; and the second side of each even row of pixels is connected to a next odd scanning signal line, in an order of scanning by the progressive scanning signal, following the even scanning signal line connected to the first side of that even row of pixels.

27. A liquid crystal display driving system comprising:

a liquid crystal display unit which has a screen of matrix arrangement comprised of a plurality of pixels, data lines for driving columns of the pixels, and m scanning signal lines for driving rows of the pixels, where m is a natural number;

means for supplying video signals to the pixels through the data lines;

directing signal generating means for generating first, second, third and fourth output directing signals;

scanning signal line control means for supplying a progressive scanning signal to the scanning signal lines, where an m-th scanning signal line on a first side of the screen is associated with an (m−1)-th scanning signal line on a second side of the screen to synchronize timing therebetween;

first sample-hold means for holding first video signals for pixels corresponding to odd rows on the first side of the screen and for supplying the first held video signals to data lines corresponding to the first side of the screen based on the first output directing signal;

second sample-hold means for holding second video signals for pixels corresponding to even rows on the first side of the screen and for supplying the second held video signals to data lines corresponding to the first side of the screen based on the second output directing signal;

third sample-hold means for holding third video signals for pixels corresponding to odd rows on the second side of the screen and for supplying the third held video signals to data lines corresponding to the second side of the screen based on the third output directing signal; and fourth sample-hold means for holding fourth video signals for pixels corresponding to even rows on the second side of the screen and for supplying the third held video signals to data lines corresponding to the second side of the screen based on the fourth output directing signal.

28. A liquid crystal display driving system as recited by claim 27, wherein the m-th scanning signal line on the first side of the screen and the (m−1)-th scanning signal line on the second side of the screen are driven by separate scanning signal line controllers within the scanning signal line controlling means.

29. A liquid crystal display driving system as recited by claim 27, wherein a direct connection is provided between the m-th scanning signal line on the first side of the screen and the (m−1)-th scanning signal line on the second side of the screen.

30. The system of claim 27, wherein the m-th scanning signal line on the first side of the screen is aligned with the (m−1)-th scanning signal line on the second side of the screen.

31. The system of claim 27, wherein:

the plurality of the scanning signal lines include a plurality of even scanning signal lines and a plurality of odd scanning signal lines;

a first side of each odd row of pixels is connected to one of the odd scanning signal lines;

a second side of each odd row of pixels is connected to one of the even scanning signal lines;

a first side of each even row of pixels is connected to one of the even scanning signal lines; and a second side of each even row of pixels is connected to one of the odd scanning signal lines, wherein at least one of the scanning signal lines is connected to a first side of a first row of pixels and a second side of a second row of pixels, where the second row of pixels precedes the first row of pixels in an order of scanning by the progressive scanning signal.

32. The system of claim 27, wherein a single one of the m scanning signal lines drives rows of pixels in both the first side and the second side of the screen.

33. The system of claim 27, wherein a single one of the m scanning signal lines drives the same row of pixels in both the first side and the second side of the screen.

34. The system of claim 27, wherein a single one of the m scanning signal lines drives different rows of pixels in the first side and the second side of the screen.

35. A liquid crystal display driving system comprising:

a liquid crystal display unit which has a screen of matrix arrangement comprised of a plurality of pixels, data lines for driving columns of the pixels, and scanning signal lines for driving rows of the pixels;

means for supplying video signals to the pixels through the data lines;

directing signal generating means for generating first, second, third and fourth output directing signals, the first output directing signal being timed differently from the second output directing signal and the third output directing signal being timed differently from the fourth output directing signal;

scanning signal line control means for supplying a progressive scanning signal to the scanning signal lines;

first sample-hold means including a first sample-hold circuit, the first sample-hold circuit being enabled by the first output directing signal, the first sample-hold means holding first video signals for pixels corresponding to only odd rows on a first side of the screen and supplying the first held video signals to data lines corresponding to the first side of the screen based on the first output directing signal;

second sample-hold means including a second sample-hold circuit, the second sample-hold circuit being enabled by the second output directing signal, the second sample-hold means holding second video signals for pixels corresponding to only even rows on the first side of the screen and supplying the second held video signals to data lines corresponding to the first side of the screen based on the second output directing signal;

third sample-hold means including a third sample-hold circuit, the third sample-hold circuit being enabled by the third output directing signal, the third sample-hold means holding third video signals for pixels corresponding to only odd rows on a second side of the screen and supplying the third held video signals to data lines corresponding to the second side of the screen based on the third output directing signal; and fourth sample-hold means including a fourth sample-hold circuit, the fourth sample-hold circuit being enabled by the fourth output directing signal, the fourth sample-hold means holding fourth video signals for pixels corresponding to only even rows on the second side of the screen and supplying the third held video signals to data lines corresponding to the second side of the screen based on the fourth output directing signal, wherein the first sample-hold circuit and the second sample-hold circuit are coupled to a first data line in the left-side of the LCD, and wherein the third sample-hold circuit and the fourth sample-hold circuit are coupled to a second data line in the right-side of the LCD.

36. The system of claim 35, wherein the same scanning signal line drives rows of pixels in both the first side and the second side of the screen.

37. The system of claim 35, wherein the same scanning signal line drives the same row of pixels in both the first side and the second side of the screen.

38. The system of claim 35, wherein the same scanning signal line drives different rows of pixels in the first side and the second side of the screen.

39. A liquid crystal display driving system comprising:

a liquid crystal display unit which has a screen of matrix arrangement comprised of a plurality of pixels, data lines for driving columns of the pixels, and scanning signal lines for driving rows of the pixels;

directing signal generating means for generating first, second, third and fourth output directing signals;

means for supplying video signals to the pixels through the data lines;

scanning signal line control means for supplying a progressive scanning signal to the scanning signal lines;

first sample-hold means for holding first video signals for pixels corresponding to only odd rows on a first side of the screen and for supplying the first held video signals to data lines corresponding to the first side of the screen based on the first output directing signal;

second sample-hold means for holding second video signals for pixels corresponding to only even rows on the first side of the screen and for supplying the second held video signals to data lines corresponding to the first side of the screen based on the second output directing signal;

third sample-hold means for holding third video signals for pixels corresponding to only odd rows on a second side of the screen and for supplying the third held video signals to data lines corresponding to the second side of the screen based on the third output directing signal; and fourth sample-hold means for holding fourth video signals for pixels corresponding to only even rows on the second side of the screen and for supplying the third held video signals to data lines corresponding to the second side of the screen based on the fourth output directing signal, wherein the first and second sample-hold means are driven during a first portion of a horizontal scanning period and the third and fourth sample-hold means are driven during a second portion of the horizontal scanning period.

40. The system of claim 39, wherein the same scanning signal line drives rows of pixels in both the first side and the second side of the screen.

41. The system of claim 39, wherein the same scanning signal line drives the same row of pixels in both the first side and the second side of the screen.

42. The system of claim 39, wherein the same scanning signal line drives different rows of pixels in the first side and the second side of the screen.

43. A liquid crystal display driving system comprising:

a liquid crystal display unit which has a screen of matrix arrangement comprised of a plurality of pixels arranged in a plurality of rows and columns relative to the display unit, data lines for driving columns of the pixels, and scanning signal lines for driving rows of the pixels;

means for supplying video signals to the pixels through the data lines;

directing signal generating means for generating first, second, third and fourth output directing signals, where the second and third output directing signals are synchronous, the first and second output directing signals are offset, and the third and fourth output directing signals are offset;

scanning signal line control means for supplying a progressive scanning signal to the scanning signal lines, where the progressive scanning signal is a periodic signal having a frequency lower than that of each of the first, second, third and fourth output directing signals;

first sample-hold means for holding first video signals for pixels corresponding to only first rows on a first side of the screen and for supplying the first held video signals to each of the data lines corresponding to the first side of the screen based on the first output directing signal;

second sample-hold means for holding second video signals for pixels corresponding to only second rows on the first side of the screen and for supplying the second held video signals to each of the data lines corresponding to the first side of the screen based on the second output directing signal;

third sample-hold means for holding third video signals for pixels corresponding to only first rows on a second side of the screen and for supplying the third held video signals to each of the data lines corresponding to the second side of the screen based on the third output directing signal; and fourth sample-hold means for holding fourth video signals for pixels corresponding to only second rows on the second side of the screen and for supplying the third held video signals to each of the data lines corresponding to the second side of the screen based on the fourth output directing signal, wherein a single scanning signal line drives different rows of pixels in the first side and the second side of the screen.

44. A system as recited by claim 43, wherein each of the output directing signals simultaneously drive pixels corresponding to a first row on the left side and pixels corresponding to a second row on the right side, where the first and second rows are misaligned.

45. The system of claim 43, wherein:

the plurality of the scanning signal lines include a plurality of even scanning signal lines and a plurality of odd scanning signal lines;

pixels corresponding to first rows on the first side of the screen are connected to one of the odd scanning signal lines;

pixels corresponding to the first rows on the second side of the screen are connected to one of the even scanning signal lines, pixels corresponding to second rows on the first side of the screen are connected to one of the even scanning signal lines; and pixels corresponding to second rows on the second side of the screen are connected to one of the odd scanning signal lines.

46. The system of claim 45, wherein:

an even scanning signal line that is connected to the pixels corresponding to a first row on the second side of the screen follows the odd scanning signal line connected to the pixels corresponding to the first row on the first side of the screen in an order of scanning by the progressive scanning signal; and an odd scanning signal line that is connected to the pixels corresponding to a second row on the second side of the screen follows the even scanning signal line that is connected to the pixels corresponding to the second row on the first side of the screen in an order of scanning by the progressive scanning signal.

47. A crystal display driving system comprising:

a liquid crystal display unit which has a screen of matrix arrangement comprised of a plurality of pixels, data lines for driving columns of the pixels, a first set of scanning signal lines for driving rows of pixels on a first side of the screen and a second set of scanning signal lines for driving rows of pixels on a second side of the screen;

means for supplying video signals to the pixels through the data lines;

directing signal generating means for generating first, second, third and fourth output directing signals, where the second and third output directing signals are synchronous, the first and second output directing signals are offset, and the third and fourth output directing signals are offset;

scanning signal line control means for supplying a progressive scanning signal to the scanning signal lines, where the progressive scanning signal is a periodic signal having a frequency lower than that of each of the first, second, third and fourth output directing signals;

first sample-hold means for holding first video signals for pixels corresponding to only first rows on a first side of the screen and for supplying the first held video signals to each of the data lines corresponding to the first side of the screen based on the first output directing signal;

second sample-hold means for holding second video signals for pixels corresponding to only second rows on the first side of the screen and for supplying the second held video signals to each of the data lines corresponding to the first side of the screen based on the second output directing signal;

third sample-hold means for holding third video signals for the pixels corresponding to only first rows on a second side of the screen and for supplying the third held video signals to each of the data lines corresponding to the second side of the screen based on the third output directing signal; and fourth sample-hold means for holding fourth video signals for pixels corresponding to only second rows on the second side of the screen and for supplying the fourth held video signals to each of the data lines corresponding to the second side of the screen based on the fourth output directing signal, wherein a single scanning signal line drives different rows of pixels in the first side and the second side of the screen.

48. The system of claim 47, wherein:

the plurality of the scanning signal lines include a plurality of even scanning signal lines and a plurality of odd scanning signal lines;

pixels corresponding to first rows on the first side of the screen are connected to one of the odd scanning signal lines;

pixels corresponding to the first rows on the second side of the screen are connected to one of the even scanning signal lines;

pixels corresponding to second rows on the first side of the screen are connected to one of the even scanning signal lines; and pixels corresponding to second rows on the second side of the screen are connected to one of the odd scanning signal lines.

49. The system of claim 48, wherein:

an even scanning signal line that is connected to the pixels corresponding to a first row on the second side of the screen follows the odd scanning signal line connected to the pixels corresponding to the first row on the first side of the screen in an order of scanning by the progressive scanning signal; and an odd scanning signal line that is connected to the pixels corresponding to a second row on the second side of the screen follows the even scanning signal line that is connected to the pixels corresponding to the second row on the first side of the screen in an order of scanning by the progressive scanning signal.

50. A system as recited by claim 47, wherein each of the output directing signals simultaneously drive pixels corresponding to a first row on the left side and pixels corresponding to a second row on the right side, where the first and second rows are misaligned.

51. A liquid crystal display driving system comprising:

a liquid crystal display unit which has a screen of matrix arrangement comprised of a plurality of pixels, data lines for driving columns of the pixels and m+1 scanning signal lines for driving m+1 rows of the pixels, where each row of pixels includes a first part and a second part, each pixel in the first part of the mth row being connected to the mth scanning signal line, and each pixel in the second part of the mth row being connected to the (m+1)th or (m−1)th scanning signal line, where m is a natural number means for supplying video signals to the pixels through the data lines;

directing signal generating means for generating first, second, third and fourth output directing signals;

scanning signal line control means for supplying progressive scanning signal to the scanning signal lines, where the progressive scanning signal is a periodic signal having a frequency lower than that of each of the first, second, third and fourth output directing signals;

first sample-hold means for holding first video signals for pixels corresponding to only first rows on a first side of the screen and for supplying the first held video signals to data lines corresponding to the first side on the screen based on the first output directing signal;

second sample-hold means for holding second video signals for pixels corresponding to only second rows on the first side of the screen and for supplying the second held video signals to data lines corresponding to the first side on the screen based on the second output directing signal;

third sample-hold means for holding third video signals for pixels corresponding to only first rows on a second side of the screen and for supplying the third held video signals to data lines corresponding to the second side on the screen based on the third output directing signal; and fourth sample-hold means for holding fourth video signals for pixels corresponding to only second rows on the second side of the screen and for supplying the fourth held video signals to data lines corresponding to the second side on the screen based on the fourth output directing signal.

52. The system of claim 51, wherein:

the plurality of the scanning signal lines include a plurality of even scanning signal lines and a plurality of odd scanning signal lines;

pixels corresponding to first rows on the first side of the screen are connected to one of the odd scanning signal lines;

pixels corresponding to the first rows on the second side of the screen are connected to one of the even scanning signal lines;

pixels corresponding to second rows on the first side of the screen are connected to one of the even scanning signal lines; and pixels corresponding to second rows on the second side of the screen are connected to one of the odd scanning signal lines.

53. The system of claim 52, wherein:

an even scanning signal line that is connected to the pixels corresponding to a first row on the second side of the screen follows the odd scanning signal line connected to the pixels corresponding to the first row on the first side of the screen in an order of scanning by the progressive scanning signal; and an odd scanning signal line that is connected to the pixels corresponding to a second row on the second side of the screen follows the even scanning signal line that is connected to the pixels corresponding to the second row on the first side of the screen in an order of scanning by the progressive scanning signal.

54. A system as recited by claim 51, wherein the second and third output directing signals are pulsed simultaneously, the first and second output enable signals are offset, and the third and fourth output enable signals are offset.

55. A liquid crystal display driving system comprising:

a liquid crystal display unit which has a screen of matrix arrangement comprised of a plurality of pixels, data lines for driving columns of the pixels, and scanning signal lines for driving rows of the pixels;

means for supplying video signals to the pixels through the data lines;

directing signal generating means for generating first, second, third and fourth output directing signals;

scanning signal line control means for supplying a progressive scanning signal to the scanning signal lines, where an m-th scanning signal line on a first side of the screen is associated with an (m−1)-th scanning signal line on a second side of the screen, thereby synchronizing timing therebetween;

first sample-hold means for holding first video signals for pixels corresponding to only first rows on the first side of the screen and for supplying the first held video signals to each of the data lines corresponding to the first side of the screen based on the first output directing signal;

second sample-hold means for holding second video signals for pixels corresponding to only second rows on the first side of the screen and for supplying the second held video signals to each of the data lines corresponding to the first side of the screen based on the second output directing signal;

third sample-hold means for holding third video signals for pixels corresponding to only first rows on the second side of the screen and for supplying the third held video signals to each of the data lines corresponding to the second side of the screen based on the third output directing signal; and fourth sample-hold means for holding fourth video signals for pixels corresponding to only second rows on the second side of the screen and for supplying the third held video signals to each of the data lines corresponding to the second side of the screen based on the fourth output directing signal, wherein a single scanning signal line drives different rows of pixels in the first side and the second side of the screen.

56. A system as recited by claim 55, wherein the second and third output directing signals are pulsed simultaneously, the first and second output enable signals are offset, and the third and fourth output enable signals are offset.

57. The system of claim 55, wherein the m-th scanning signal line on the first side of the screen is aligned with the (m−1)-th scanning signal line on the second side of the screen.

58. A liquid crystal display driving system comprising:

a liquid crystal display unit which has a screen of matrix arrangement comprised of a plurality of pixels, data lines for driving columns of the pixels, and scanning signal lines for driving rows of the pixels;

means for supplying video signals to the pixels through the data lines;

directing signal generating means for generating first, second, third and fourth output directing signals, the first output directing signal being timed differently from the second output directing signal and the third output directing signal being timed differently from the fourth output directing signal, the second and third output directing signals being synchronously timed;

scanning signal line control means for supplying a progressive scanning signal to the scanning signal lines;

first sample-hold means including a first sample-hold circuit, the first sample-hold circuit being enabled by the first output directing signal, the first sample-hold means holding first video signals for pixels corresponding to only first rows on a first side of the screen and supplying the first held video signals to each of the data lines corresponding to the first side of the screen based on the first output directing signal;

second sample-hold means including a second sample-hold circuit, the second sample-hold circuit being enabled by the second output directing signal, the second sample-hold means holding second video signals for pixels corresponding to only second rows on the first side of the screen and supplying the second held video signals to each of the data lines corresponding to the first side of the screen based on the second output directing signal;

third sample-hold means including a third sample-hold circuit, the third sample-hold circuit being enabled by the third output directing signal, the third sample-hold means holding third video signals for pixels corresponding to only first rows on a second side of the screen and supplying the third held video signals to each of the data lines corresponding to the second side of the screen based on the third output directing signal; and fourth sample-hold means including a fourth sample-hold circuit, the fourth sample-hold circuit being enabled by the fourth output directing signal, the fourth sample-hold means holding fourth video signals for pixels corresponding to only second rows on the second side of the screen and supplying the third held video signals to each of the data lines corresponding to the second side of the screen based on the fourth output directing signal, wherein the first sample-hold circuit and the second sample-hold circuit are coupled to a first data line in the left-side of the LCD, wherein the third sample-hold circuit and the fourth sample-hold circuit are coupled to a second data line in the right-side of the LCD, and where a single scanning signal line drives different rows of pixels in the first side and the second side of the screen.

59. A system as recited by claim 58, wherein each of the output directing signals simultaneously drive pixels corresponding to a first row on the left side and pixels corresponding to a second row on the right side, where the first and second rows are misaligned.

60. A liquid crystal display driving system comprising:

a liquid crystal display unit which has a screen of matrix arrangement comprised of a plurality of pixels, data lines for driving columns of the pixels, and scanning signal lines for driving rows of the pixels;

directing signal generating means for generating first, second, third and fourth output directing signals, where the second and third output directing signals are synchronous, the first and second output directing signals are offset, and the third and fourth output directing signals are offset;

means for supplying video signals to the pixels through the data lines;

scanning signal line control means for supplying a progressive scanning signal to the scanning signal lines;

first sample-hold means for holding first video signals for pixels corresponding to only first rows on a first side of the screen and for supplying the first held video signals to each of the data lines corresponding to the first side of the screen based on the first output directing signal;

second sample-hold means for holding second video signals for pixels corresponding to only second rows on the first side of the screen and for supplying the second held video signals to each of the data lines corresponding to the first side of the screen based on the second output directing signal;

third sample-hold means for holding third video signals for pixels corresponding to only first rows on a second side of the screen and for supplying the third held video signals to each of the data lines corresponding to the second side of the screen based on the third output directing signal; and fourth sample-hold means for holding fourth video signals for pixels corresponding to only second rows on the second side of the screen and for supplying the third held video signals to each of the data lines corresponding to the second side of the screen based on the fourth output directing signal, wherein the first and second sample-hold means are driven during a first portion of a horizontal scanning period and the third and fourth sample-hold means are driven during a second portion of the horizontal scanning period, wherein a single scanning signal line drives different rows of pixels in the first side and the second side of the screen.

61. A system as recited by claim 60, wherein each of the output directing signals simultaneously drive pixels corresponding to a first row on the left side and pixels corresponding to a second row on the right side, where the first and second rows are misaligned.

* * * * *